US006084504A

United States Patent [19]

Rosche et al.

[11] Patent Number: 6,084,504

[45] Date of Patent: Jul. 4, 2000

[54] TIMING

[75] Inventors: Roger M. Rosche, Singapore, Singapore; Han Kort, Zoeterwoude, Netherlands

[73] Assignee: Remind Cap Pte. Ltd., Singapore, Singapore

[21] Appl. No.: 09/223,128

[22] Filed: Dec. 30, 1998

[51] Int. Cl.[7] ..... G08B 1/00

[52] U.S. Cl. ..... 340/309.15; 700/231; 368/244; 368/89; 222/638; 222/639

[58] Field of Search ..... 340/309.15, 825.19, 340/568.1; 368/244, 89; 700/231; 222/638, 639

[56] References Cited

U.S. PATENT DOCUMENTS

| | | | |
|---|---|---|---|
| 3,921,568 | 11/1975 | Fish | 116/121 |
| 4,065,916 | 1/1978 | Leuschner | 58/23 BA |
| 4,361,408 | 11/1982 | Wirtschafter | 368/10 |
| 4,367,955 | 1/1983 | Ballew | 368/10 |
| 4,419,016 | 12/1983 | Zoltan | 368/10 |
| 4,483,626 | 11/1984 | Noble | 368/10 |
| 4,588,303 | 5/1986 | Wirtschafter et al. | 368/10 |
| 4,589,780 | 5/1986 | Takebe | 368/245 |
| 4,725,997 | 2/1988 | Urquhart et al. | 368/10 |
| 4,748,600 | 5/1988 | Urquhart et al. | 368/10 |
| 4,768,176 | 8/1988 | Kehr et al. | 368/10 |
| 4,768,177 | 8/1988 | Kehr et al. | 368/10 |
| 4,837,719 | 6/1989 | McIntosh et al. | 364/569 |
| 4,939,705 | 7/1990 | Hamilton et al. | 368/10 |
| 4,971,221 | 11/1990 | Urquhart et al. | 221/2 |
| 5,016,230 | 5/1991 | Seifers et al. | 368/10 |
| 5,233,571 | 8/1993 | Wirtschafter | 368/10 |
| 5,313,439 | 5/1994 | Albeck | 368/10 |
| 5,850,344 | 12/1998 | Conkright | 364/479.01 |

FOREIGN PATENT DOCUMENTS

| | | | |
|---|---|---|---|
| 0 407 178 A2 | 1/1991 | European Pat. Off. | G04G 15/00 |
| 0 407 178 B1 | 1/1991 | European Pat. Off. | A61J 7/05 |
| 26 03 248 B1 | 1/1976 | Germany | G04F 3/06 |
| WO 80/00766 | 4/1980 | WIPO | G04F 8/00 |

OTHER PUBLICATIONS

"Adultproof Cap: a way to keep patients honest", Time, Jun. 5, 1989.

*Primary Examiner*—Daryl Pope
*Attorney, Agent, or Firm*—Fish & Richardson

[57] ABSTRACT

A method and apparatus that is attachable to a receptacle for timing a predetermined interval according to a timing schedule of a set of timing schedules. The apparatus has an electronic timing circuit that provides an alarm signal at the expiration of the predetermined time interval. The timing circuit includes a set of inputs and a set of outputs that are both connected to processing circuitry. The processing circuitry defines the set of selectable timing schedules. The inputs correspond to the timing schedules, and the outputs issue the alarm signals. The apparatus also includes a sensing mechanism for selectively engaging an input based on the position of the mechanism. Each timing schedule is selectable by the device through the inputs that are engaged and disengaged.

29 Claims, 26 Drawing Sheets

*By 36 Days Check when "Tone_sel" = Demo mode

TIMING

The present invention relates to timing and, in particular, to timing for providing recurring events, such as a sound signal or a visual signal, according to a predetermined schedule that indicates the proper time to administer medication as prescribed or otherwise required.

For background, reference is made to U.S. Pat. No. 5,016,230 of Monte Seifers et al. entitled TIMING.

It is an important object of the invention to provide improved methods and devices for timing.

One aspect of the invention is a device that is attachable to a receptacle for timing a predetermined interval according to a timing schedule of a set of timing schedules. The device has an electronic timing circuit that provides an alarm signal at the expiration of the predetermined time interval. The timing circuit includes a set of inputs and a set of outputs that are both connected to processing circuitry. The processing circuitry includes the set of selectable timing schedules. The inputs correspond to the timing schedules, and the outputs issue the alarm signals.

The device also includes a sensing mechanism for selectively engaging an input. The mechanism electrically engages and disengages the input based on the position of the mechanism. Each timing schedule is selectable by the device through the inputs that are engaged and disengaged.

Embodiments of this aspect of the invention include one or more of the following features.

The sensing mechanism is in mechanical communication with the inputs, and the sensing mechanism changes position in response to a nonfrictional normal force. A selector mechanism allows the timing schedules to be mechanically selected.

The device includes two alarm transducers, a light source and a sound source, that are each connected to one of two outputs. A power source is engaged by an activation mechanism. When in an activated position, the mechanism engages the timing circuit and provides an electrical connection to the power source, and, when in a deactivated position, the power source is disengaged from the timing circuit.

The device also includes several functions: a synchronization function to synchronize the predetermined timing interval relative to an external event; a mute function to suppress alarm signals when the device is not in use; an alarm preempt function to suppress alarm signals when, prior to the expiration of the timing interval, the sensing mechanism moves between positions (indicating, for example, that the device has been removed from the receptacle and that medication has been consumed); and a shutdown function to suppress alarm signals after a predetermined duration, e.g., 36 days.

The device includes a reset mechanism that is in communication with the timing circuit. The reset mechanism is capable of engaging another input of the set of inputs to activate some or all of the functions.

Another aspect of the invention is a method of timing. A timing schedule, which includes a timing interval, is selected from a set of timing schedules stored in a container. The timing interval is timed, and, at the expiration of the interval, an alarm signal issues from the container.

Embodiments within the scope of the claims may have one or more of the following advantages. The timing schedule can be selectable. The closure mechanism of the medication container can be highly reliable. The reliability rates of certain embodiments may be close to 100%. The closure mechanism of the medication container may rely on forces other than friction forces, and thereby reduce wear on the moving parts and help avoid premature failure. The medication container can be manufactured such that the electronic mode of the timing device will not switch unexpectedly and will not switch unless the medication container is manipulated in the manner intended to switch the electronic mode, e.g., opening the medication container to initiate a timing reset mode.

Other features, objects and advantages will become apparent from the following detailed description when read in connection with the accompanying drawings in which.

Figure 1:
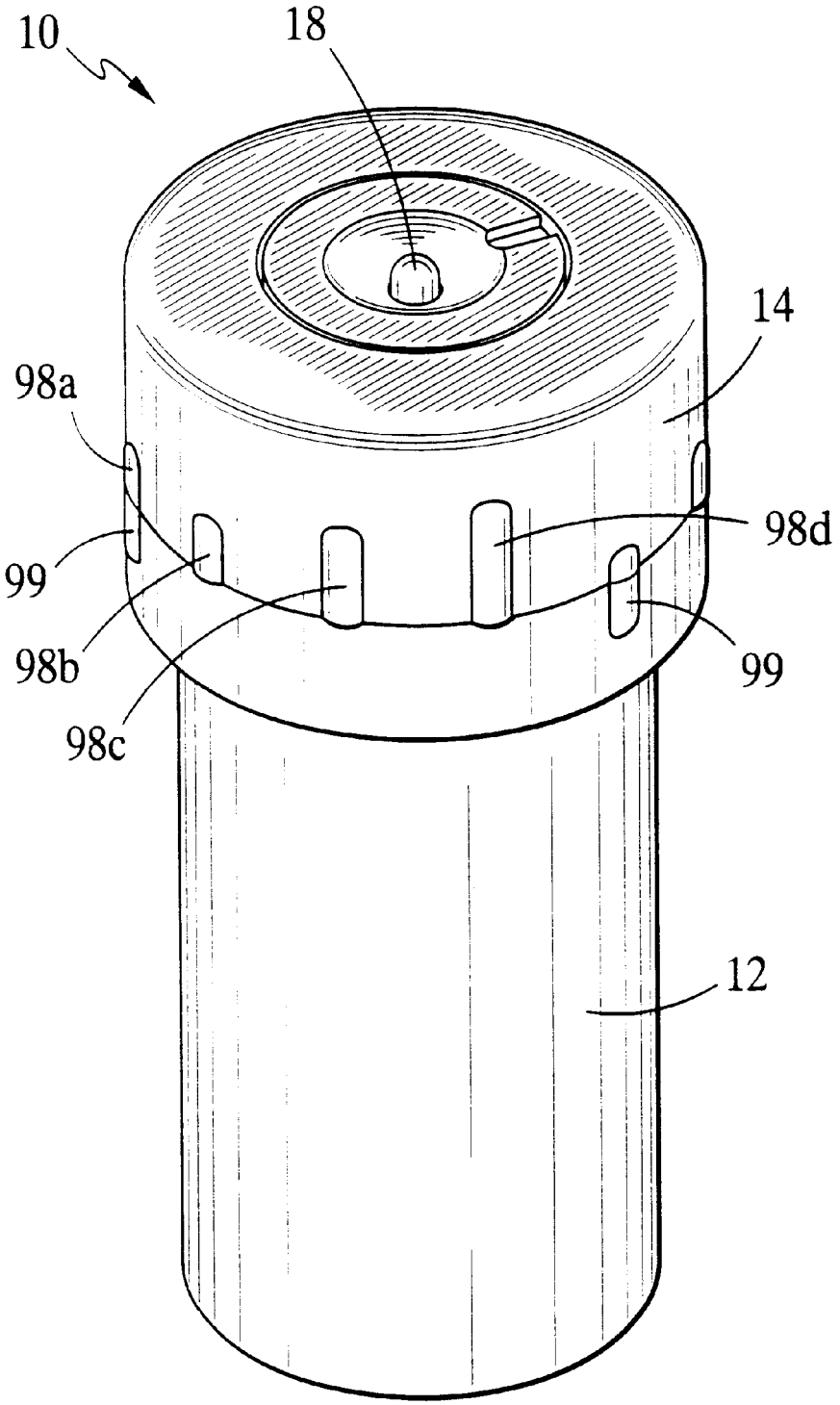
FIG. 1 is a perspective view of a medication container having a cap according to the invention, wherein the cap attaches to a currently existing receptacle.
Figure 6A:
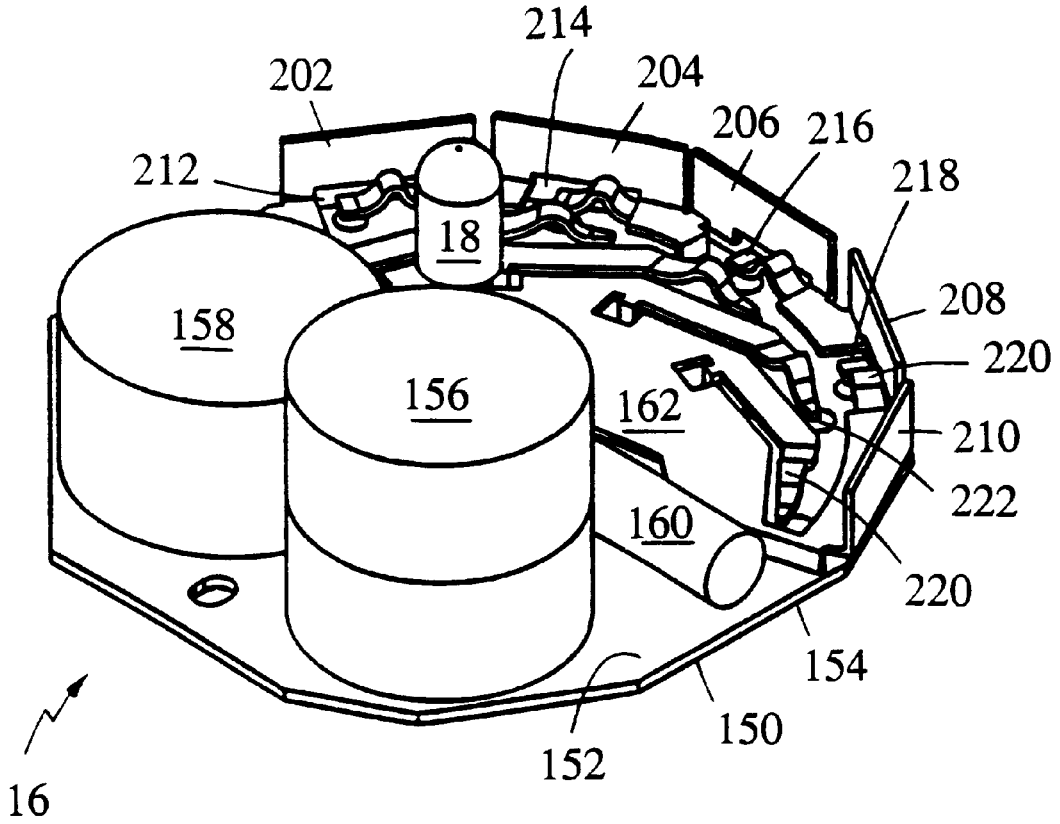
Figure 6B:
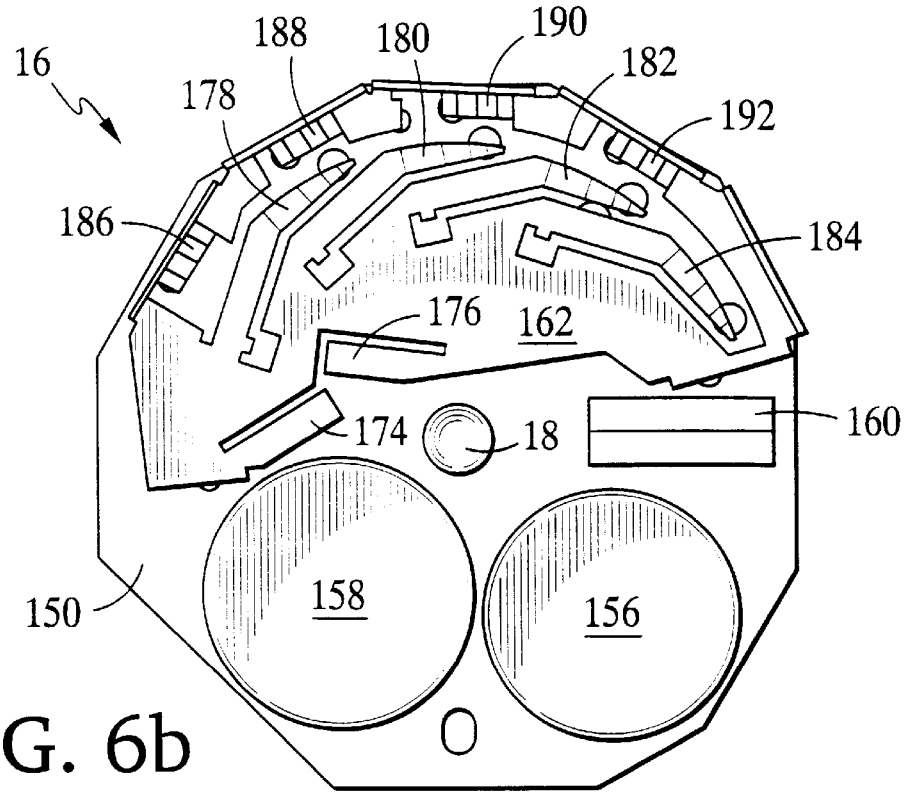

FIG. 6*a* is a perspective view of an anterior side of a timing device of the cap of FIG. 1;

FIG. 6*b* is a schematic view of the anterior side of the timing device of FIG. 6*a;*

Figure 6C:
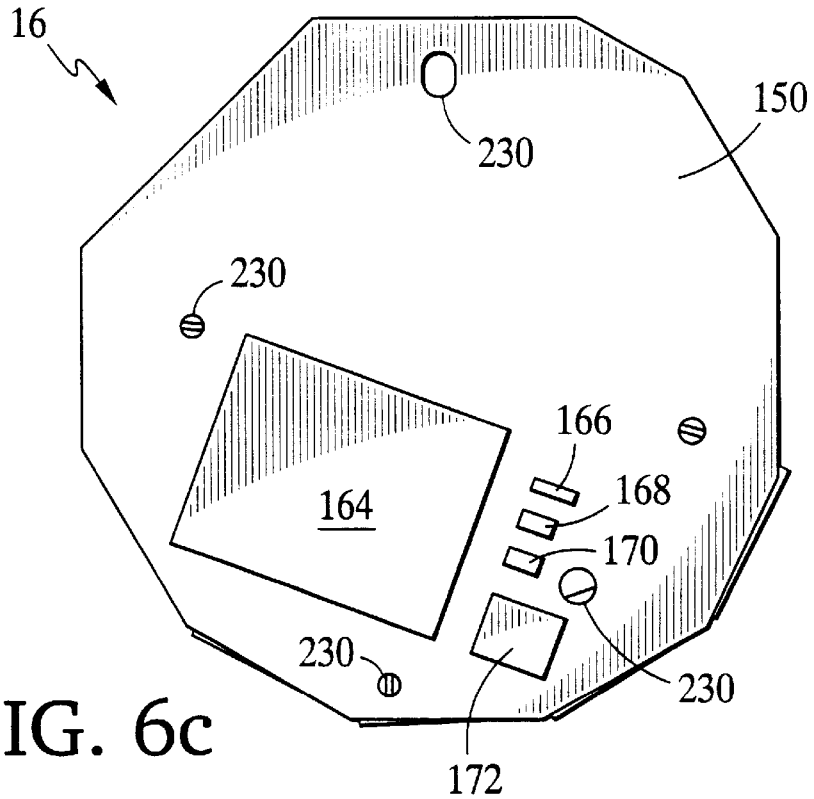

FIG. 6*c* is a schematic view of a posterior side of the timing device of FIG. 6*a;*

Figure 6D:
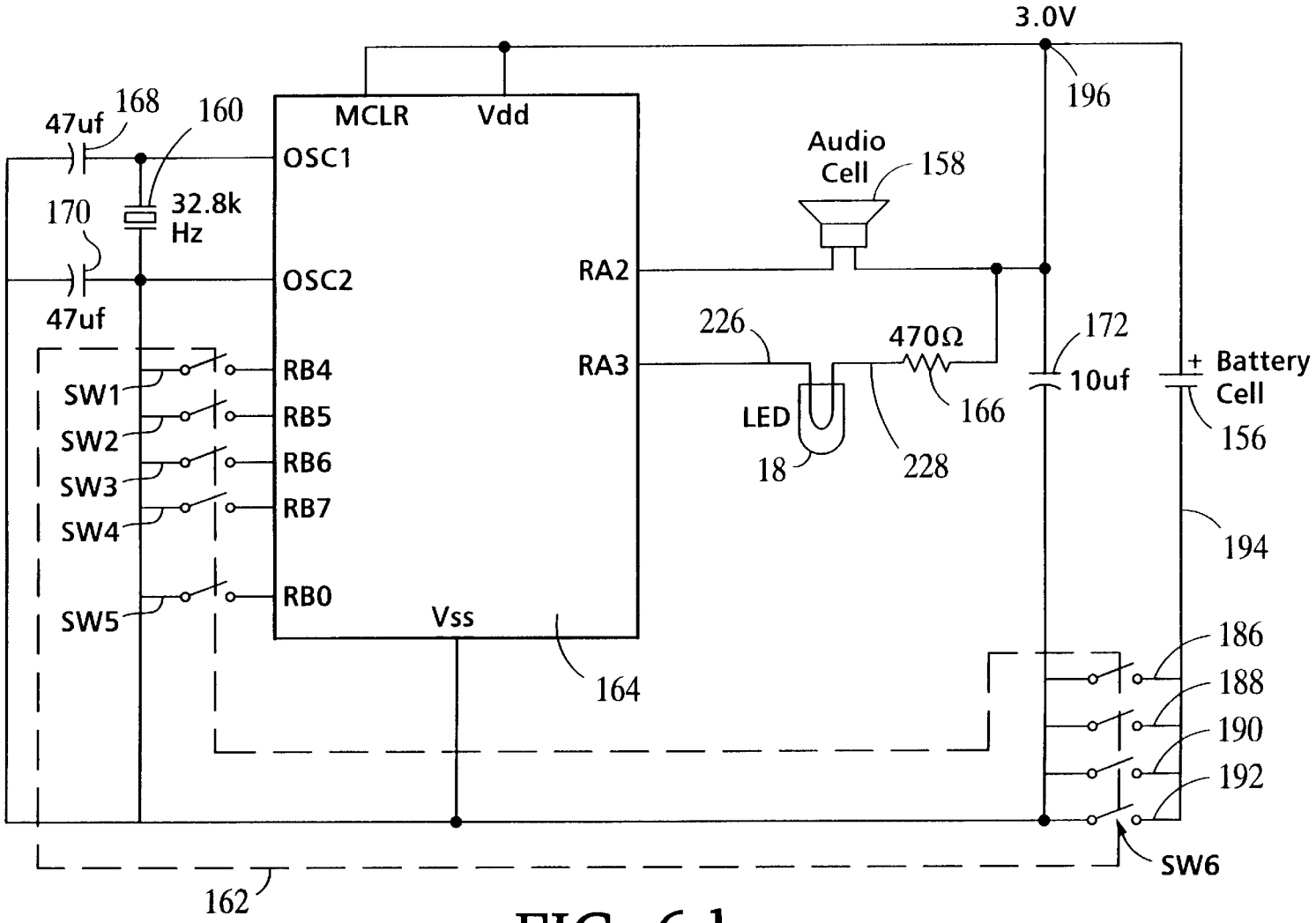

FIG. 6*d* is a diagrammatic view of the electrical components of the timing device of FIG. 6*a*

Figure 7A:
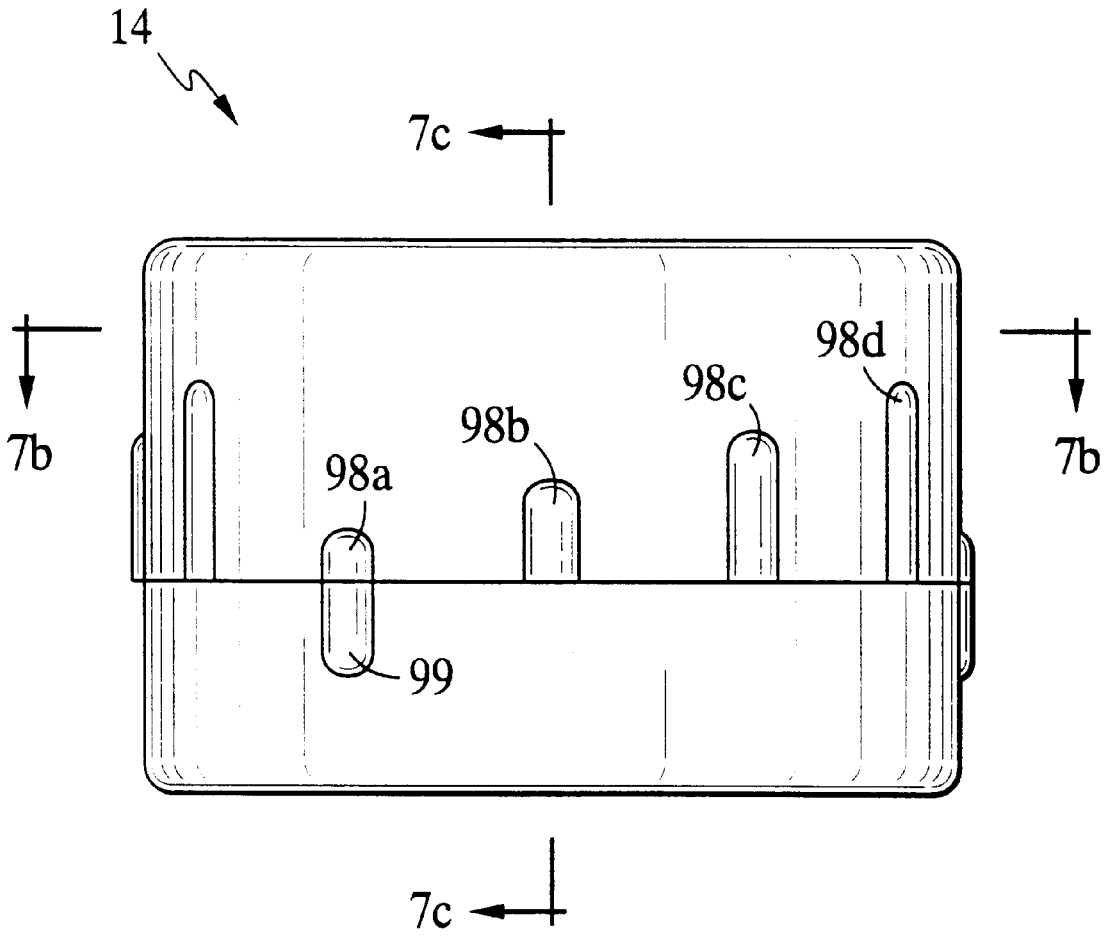
Figure 7B:
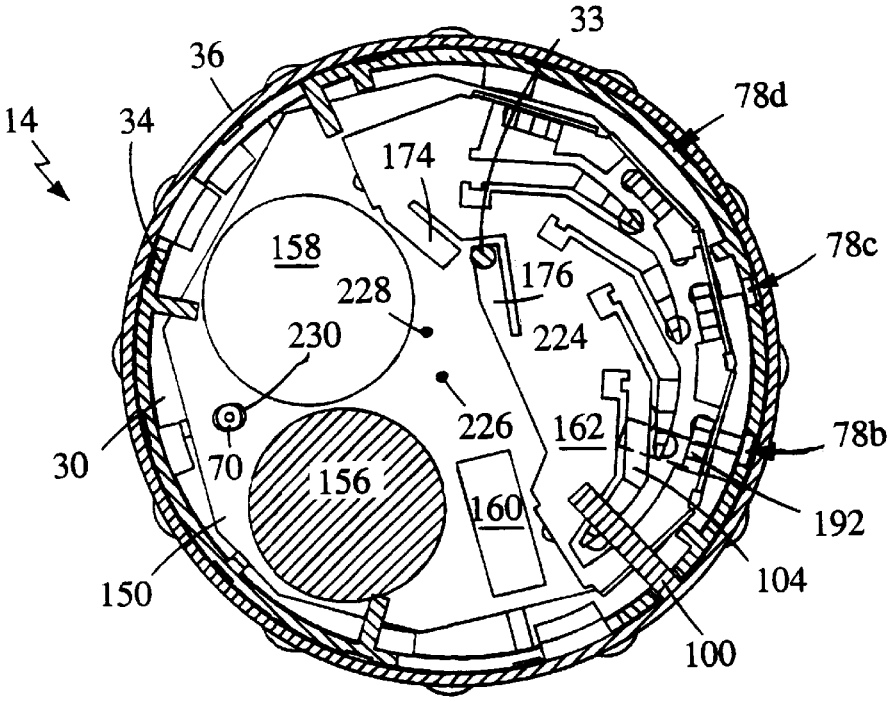
Figure 7C:
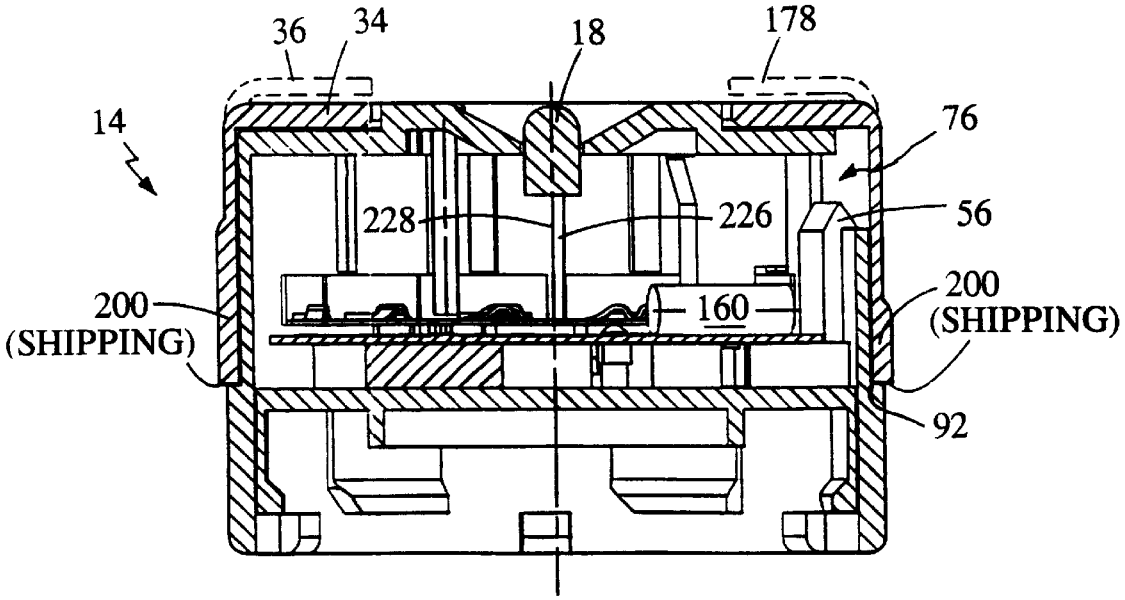
Figure 8:
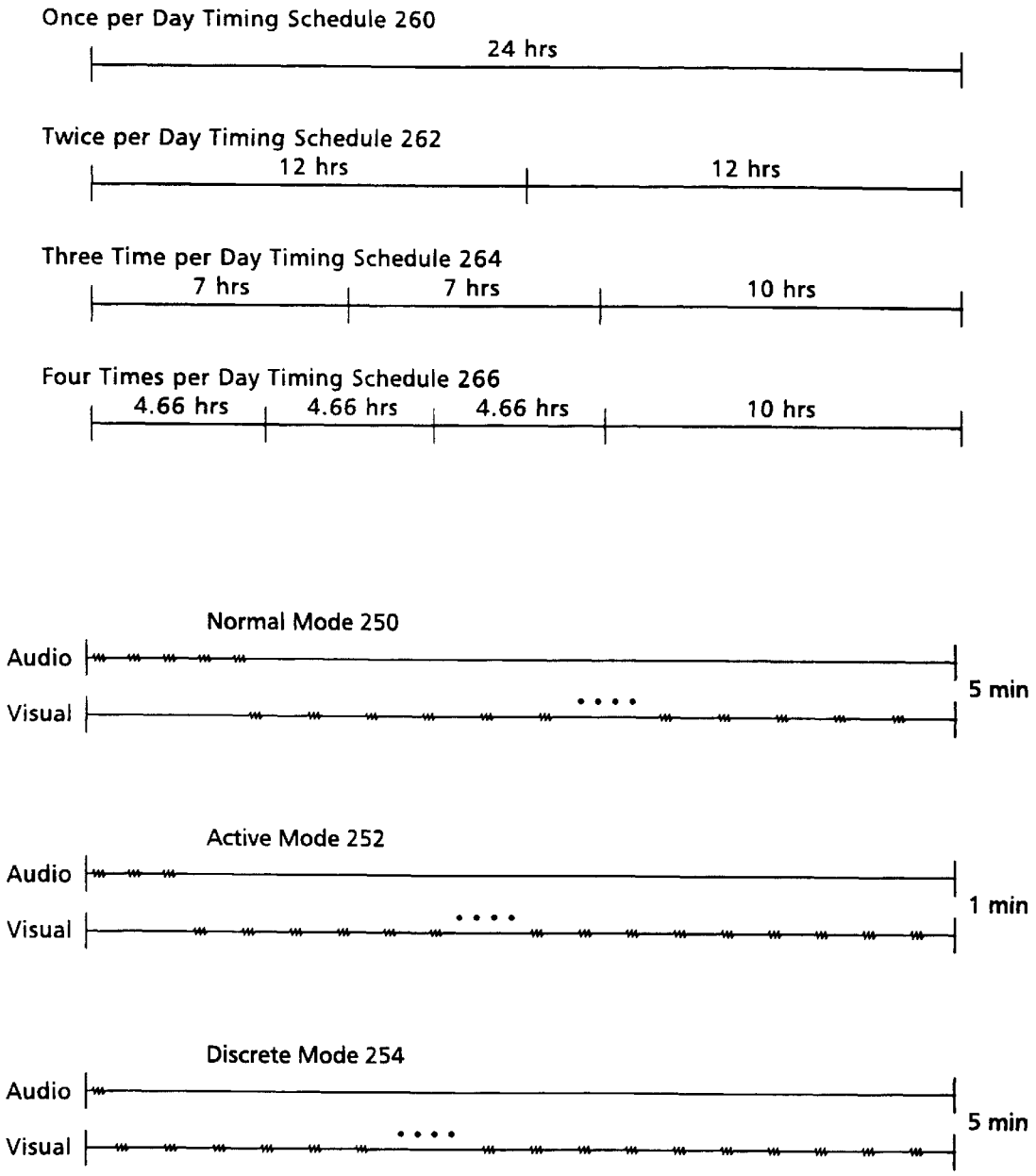

FIG. 7*a* is a schematic view of the cap of the container of FIG. 1 wherein the cap is fully assembled;

FIG. 7*b* is a cross-sectional view of the cap along line 7*b*—7*b* of FIG. 7*a* showing the interrelation of both mechanical and electrical components of the cap;

FIG. 7*c* is a cross-sectional view of the cap along line 7*c*—7*c* of FIG. 7*a* showing the interrelation of both mechanical and electrical components of the cap;

FIG. 8 is a diagrammatic view of alarm signals issued by the timing device of FIG. 6*a;*

Figure 10:
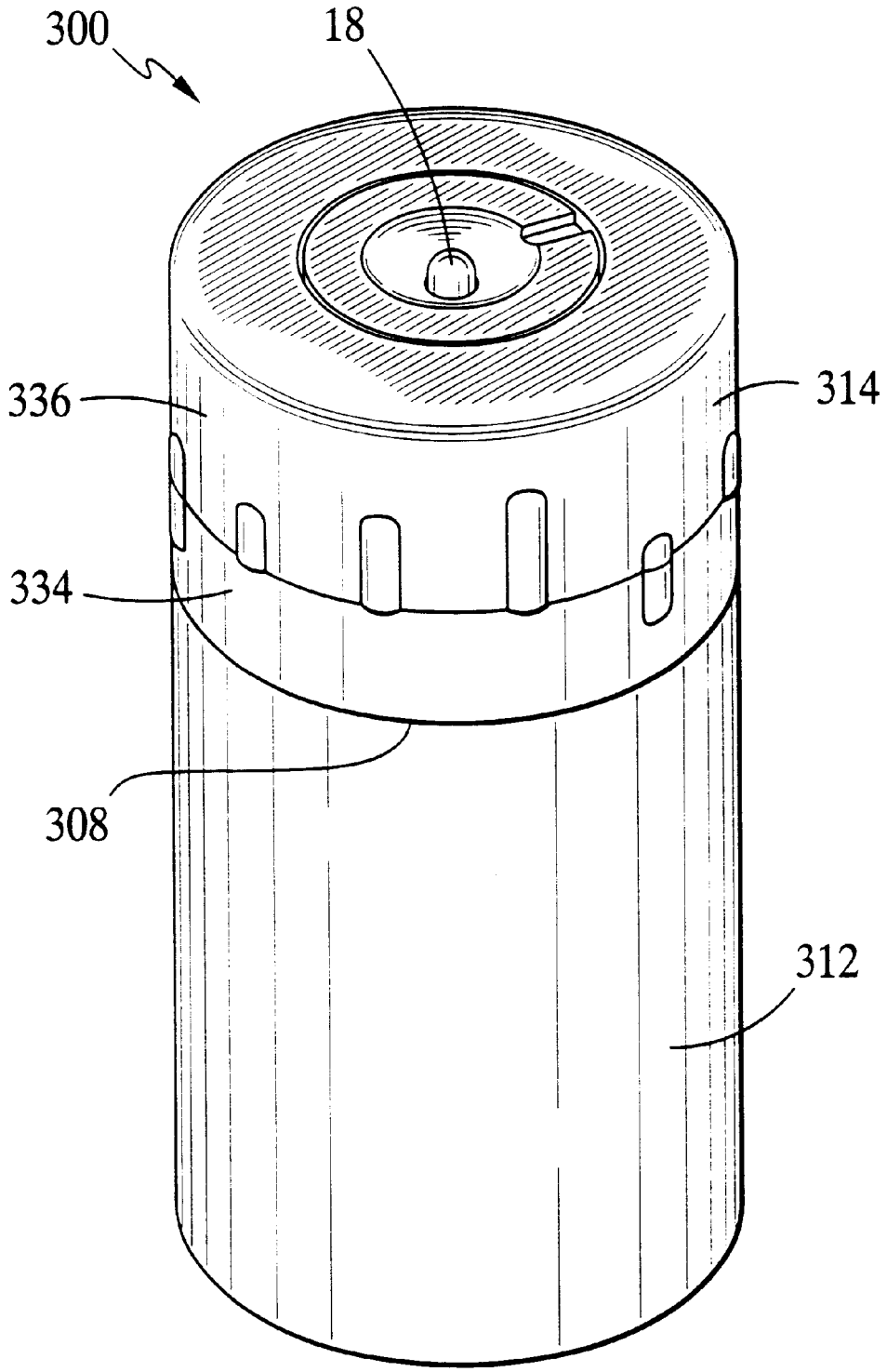
Figure 11:
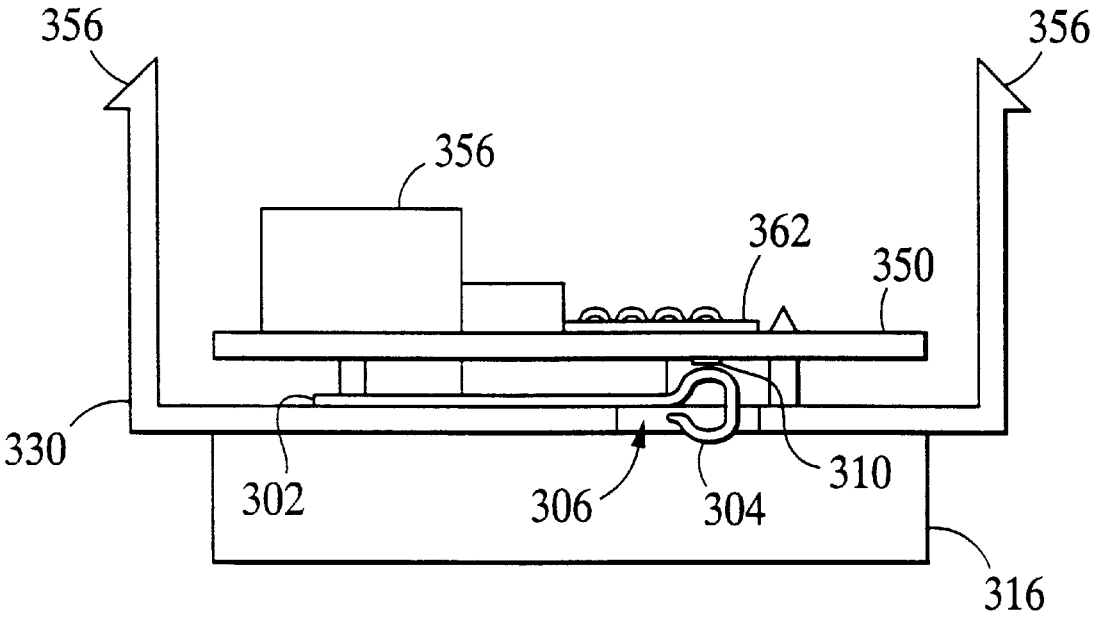
Figure 12:
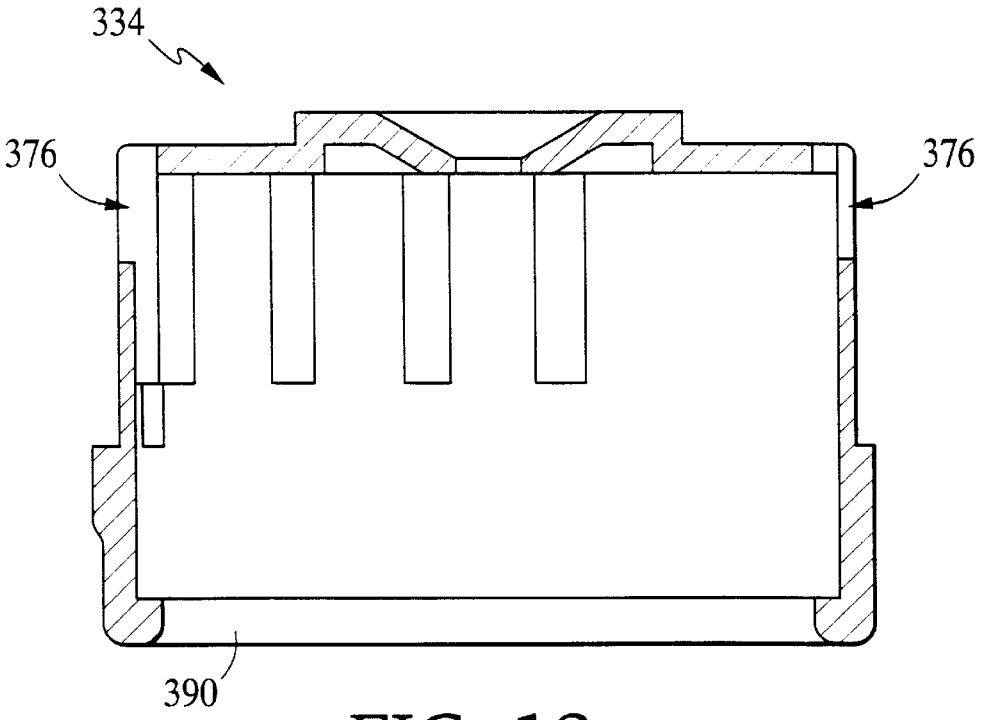
Figure 13:
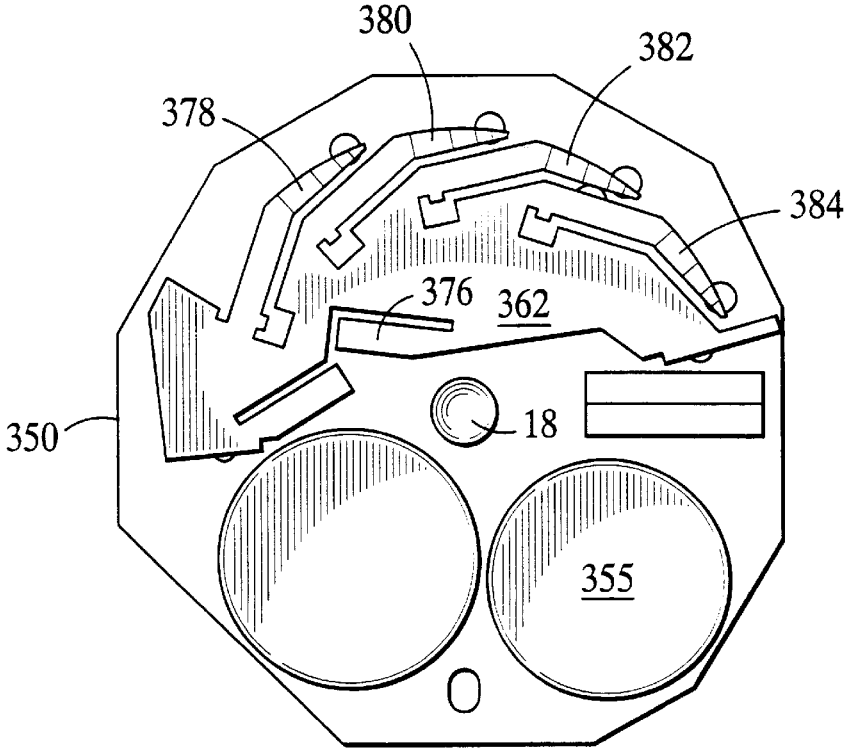

FIGS. 9*a*–9*f* are flowcharts representing the logic used by the medication container of FIG. 1;

FIG. 10 is a perspective view of an alternate embodiment of the medication container of FIG. 1;

FIG. 11 is schematic view of a trigger of the medication container of FIG. 10;

FIG. 12 is a cross-sectional side view of a main housing of the medication container of FIG. 10; and FIG. 13 is a schematic view of the anterior side of a timing device of the medication container of FIG. 10.

Figure 14:
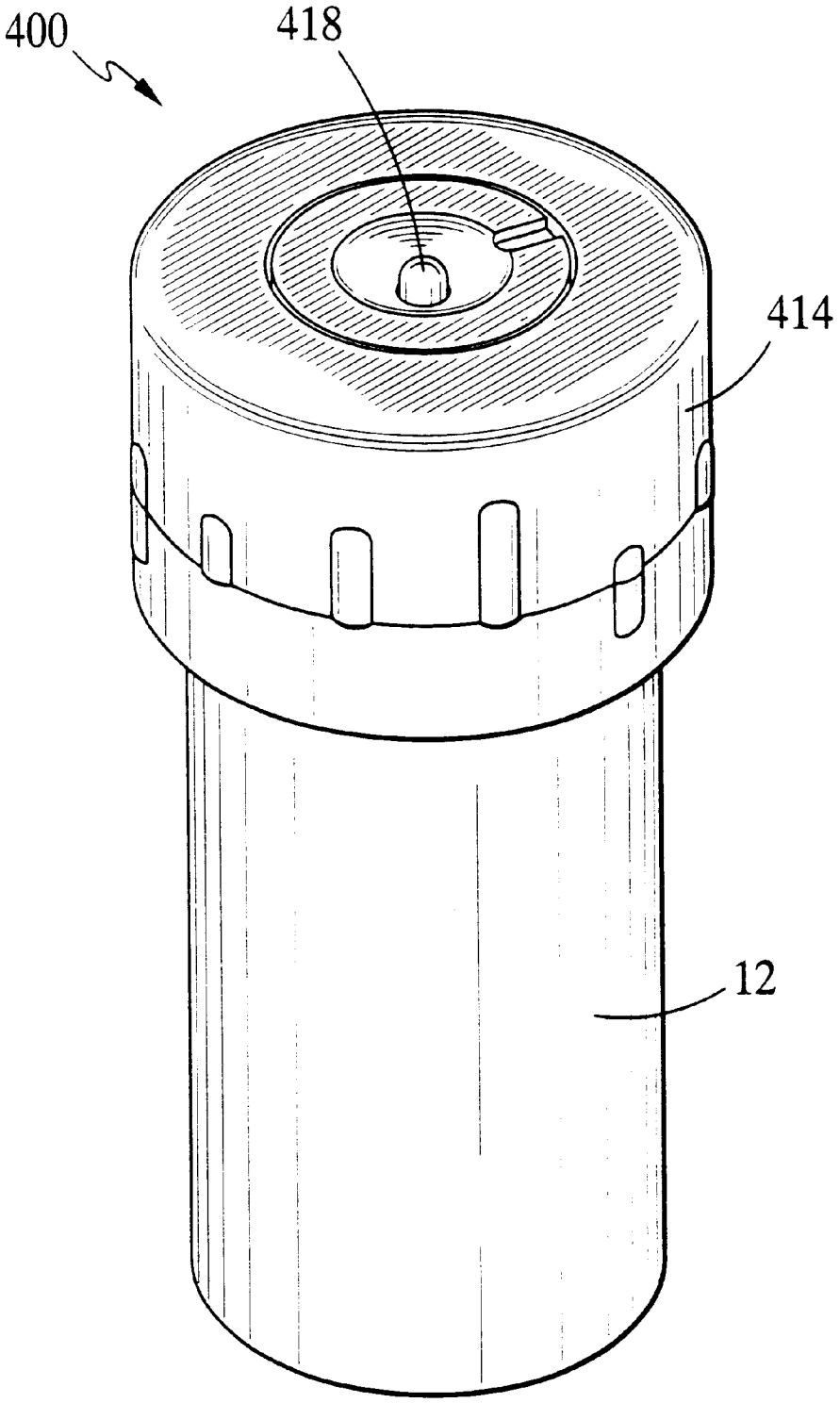
Figure 15:
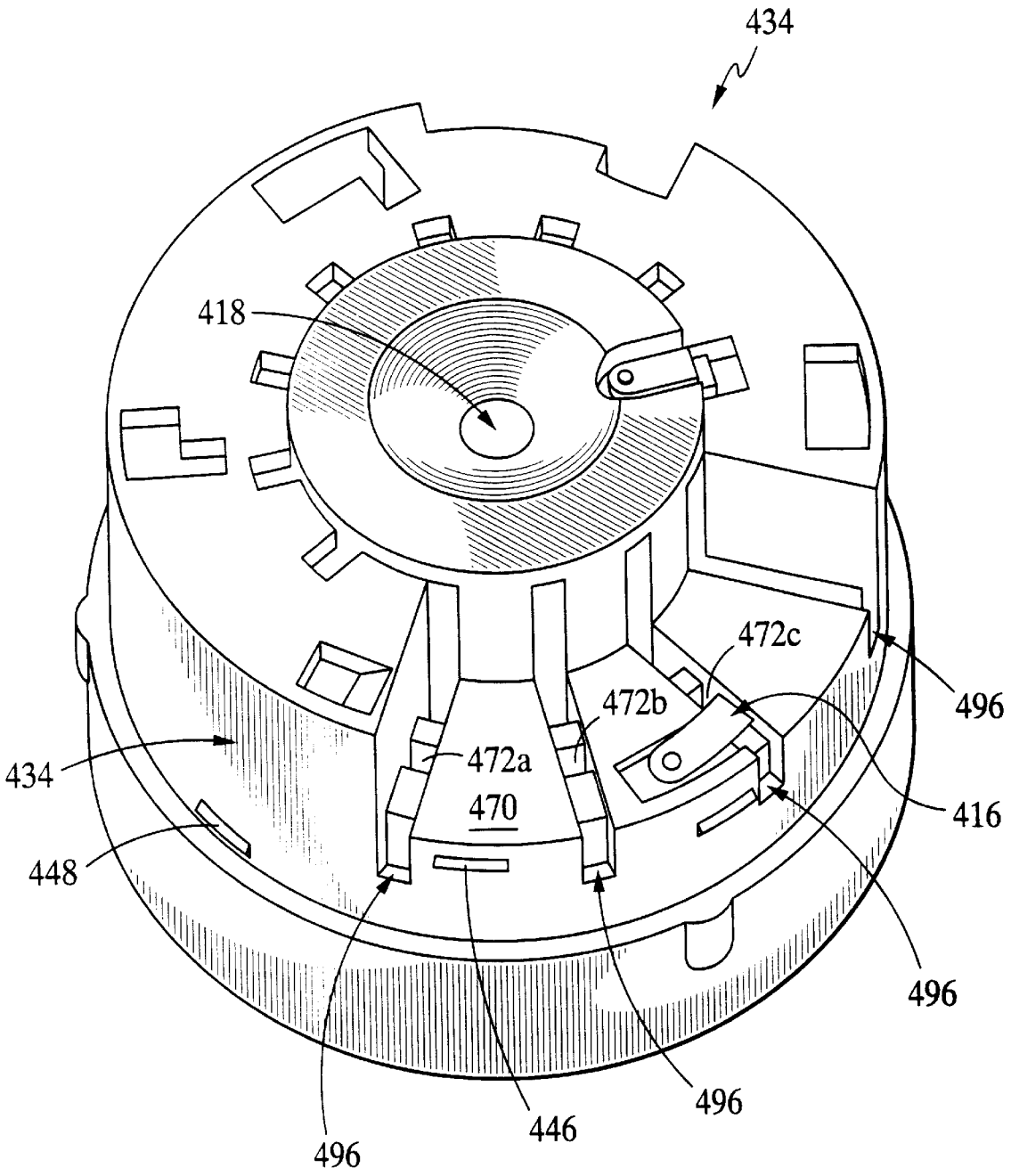
Figure 16:
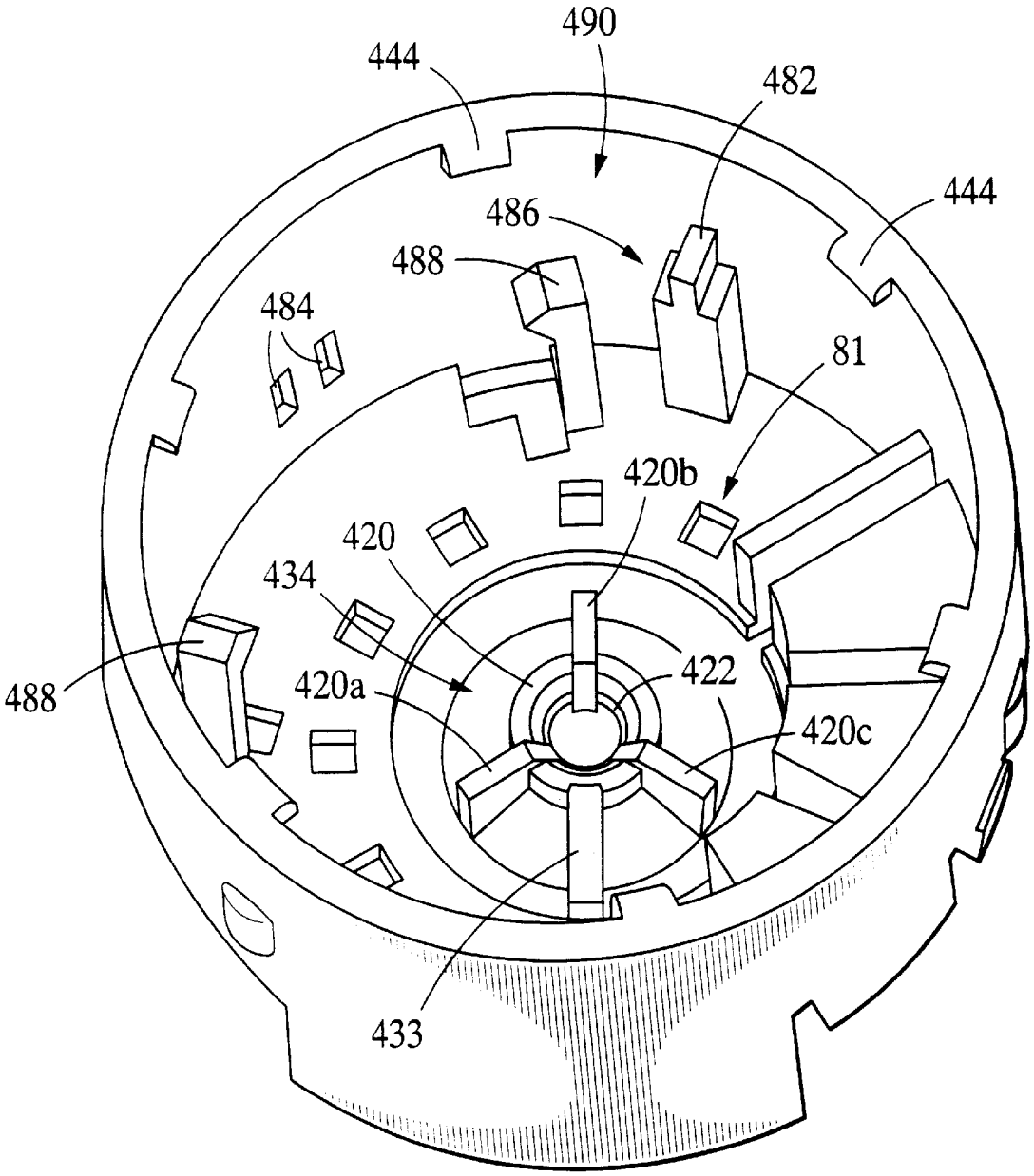
Figure 17:
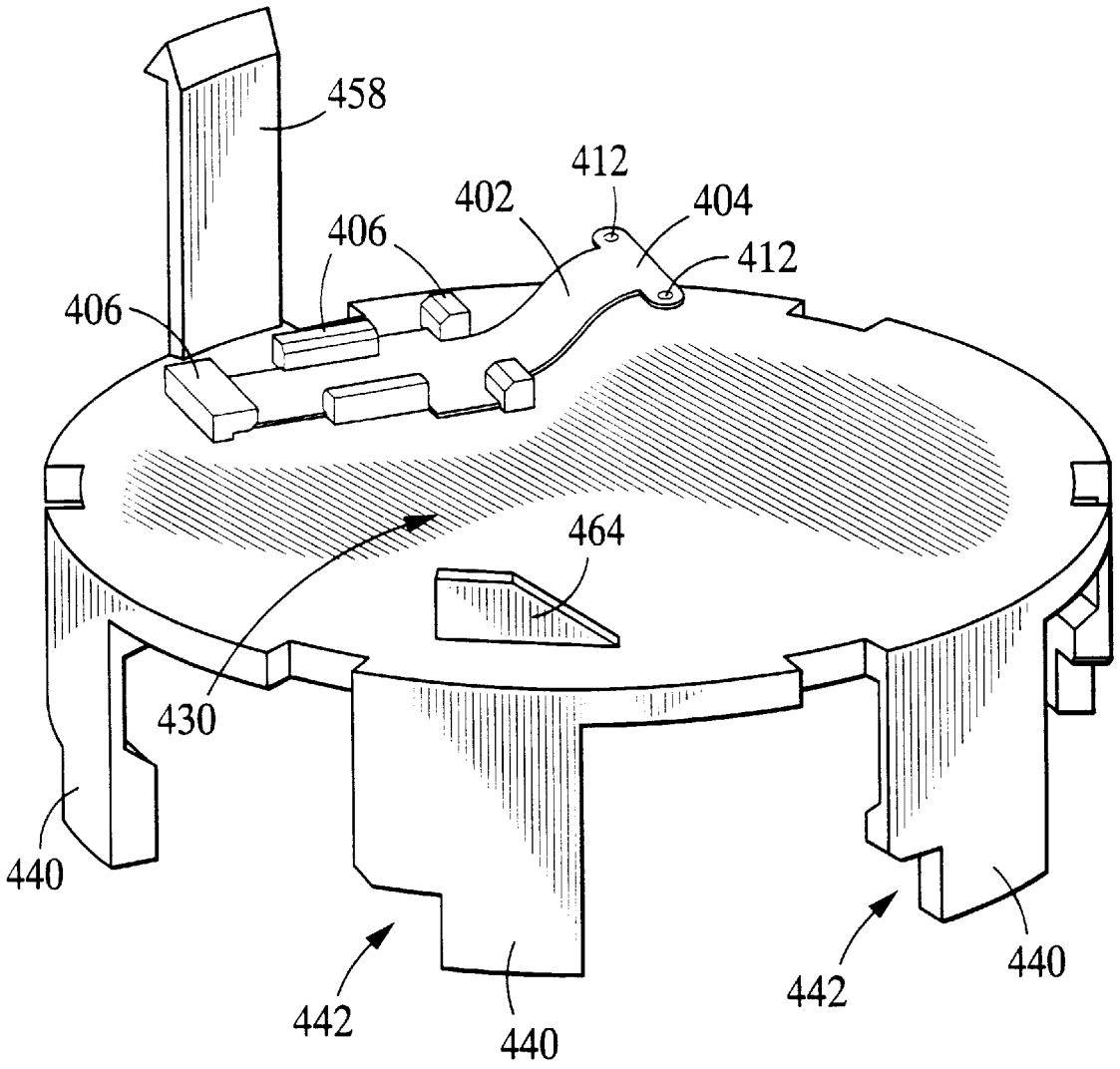
Figure 18:
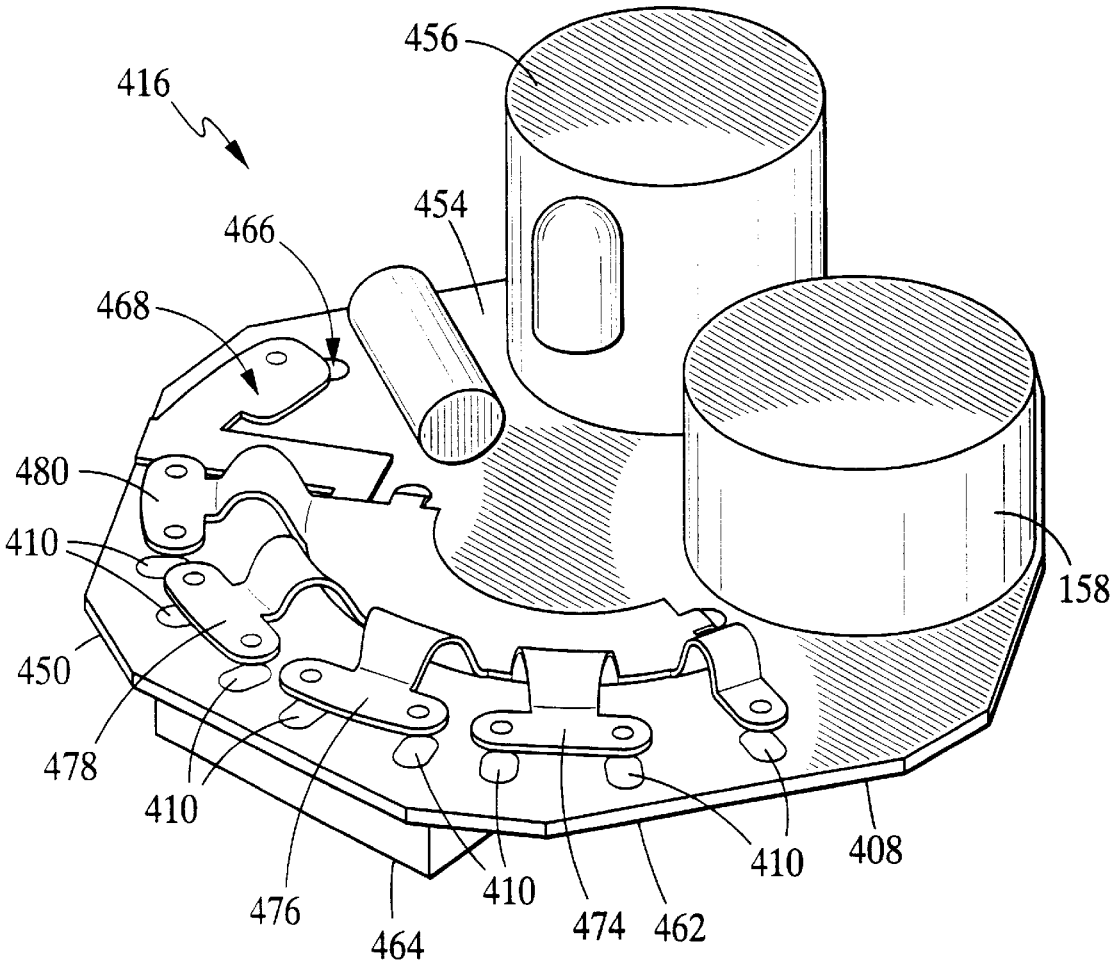
Figure 19:
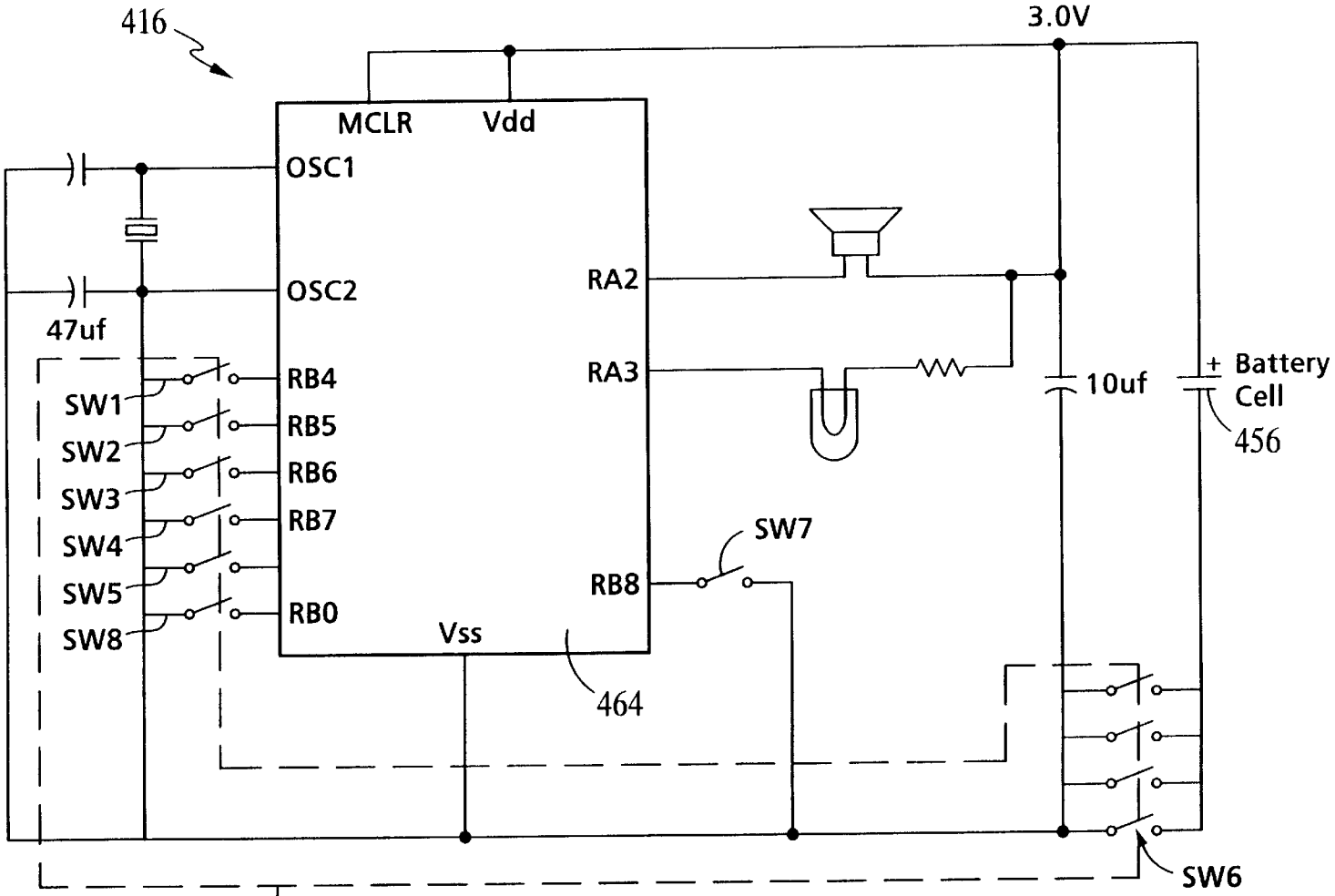

FIG. 14 is a perspective view of a third embodiment of the medication container of FIG. 1;

FIG. 15 is top perspective view of a main housing of the medication container of FIG. 14;

FIG. 16 is a bottom perspective view of the main housing FIG. 15;

FIG. 17 is a perspective view of a trigger of the medication container of FIG. 14;

FIG. 18 is a perspective view of a timing device of the medication container of FIG. 14;

FIG. 19 is a diagrammatic view of the timing device of FIG. 18; and

Figure 20:
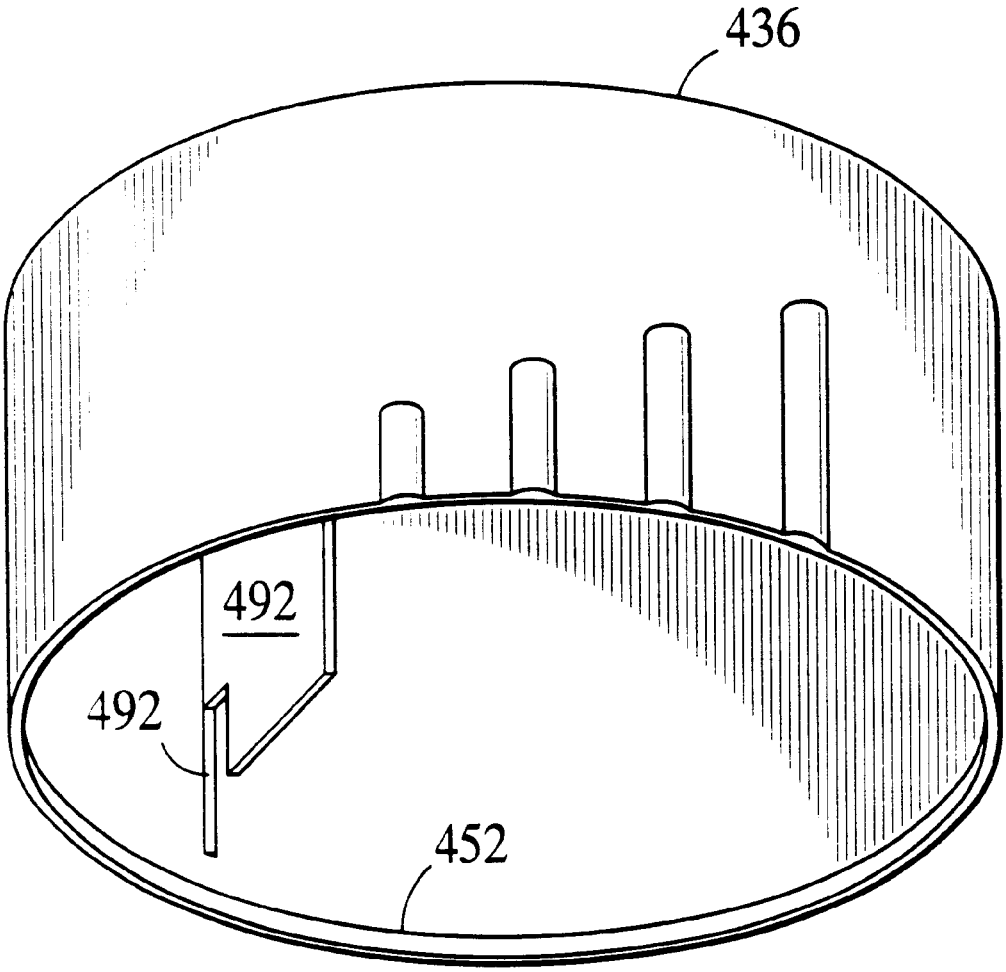

FIG. 20 is a perspective view of a ring of the medication container of FIG. 14.

Referring to FIG. 1, a medication container 10 includes a receptacle 12 suitable for containing prescription medication and a cap 14 to enclose the medication in container 10. Cap 14 includes a timing device 16 (FIG. 2) to provide an alarm signal according to a predetermined schedule that indicates the appropriate time to administer the medication as prescribed by a physician. Based on the prescription, a pharmacist can select the predetermined schedule from several schedules stored within cap 14.

When medication container 10 activates the alarm signals, which are a combination of a repetitive "beeping" sound and a flashing LED 18, a patient opens container 10 by removing cap 14 from receptacle 12 to access the medication. At that time, medication container 10 senses that cap 14 was removed and resets the alarm. Medication container 10 then monitors the time to activate the alarm after a predefined interval expires.

Figure 2:
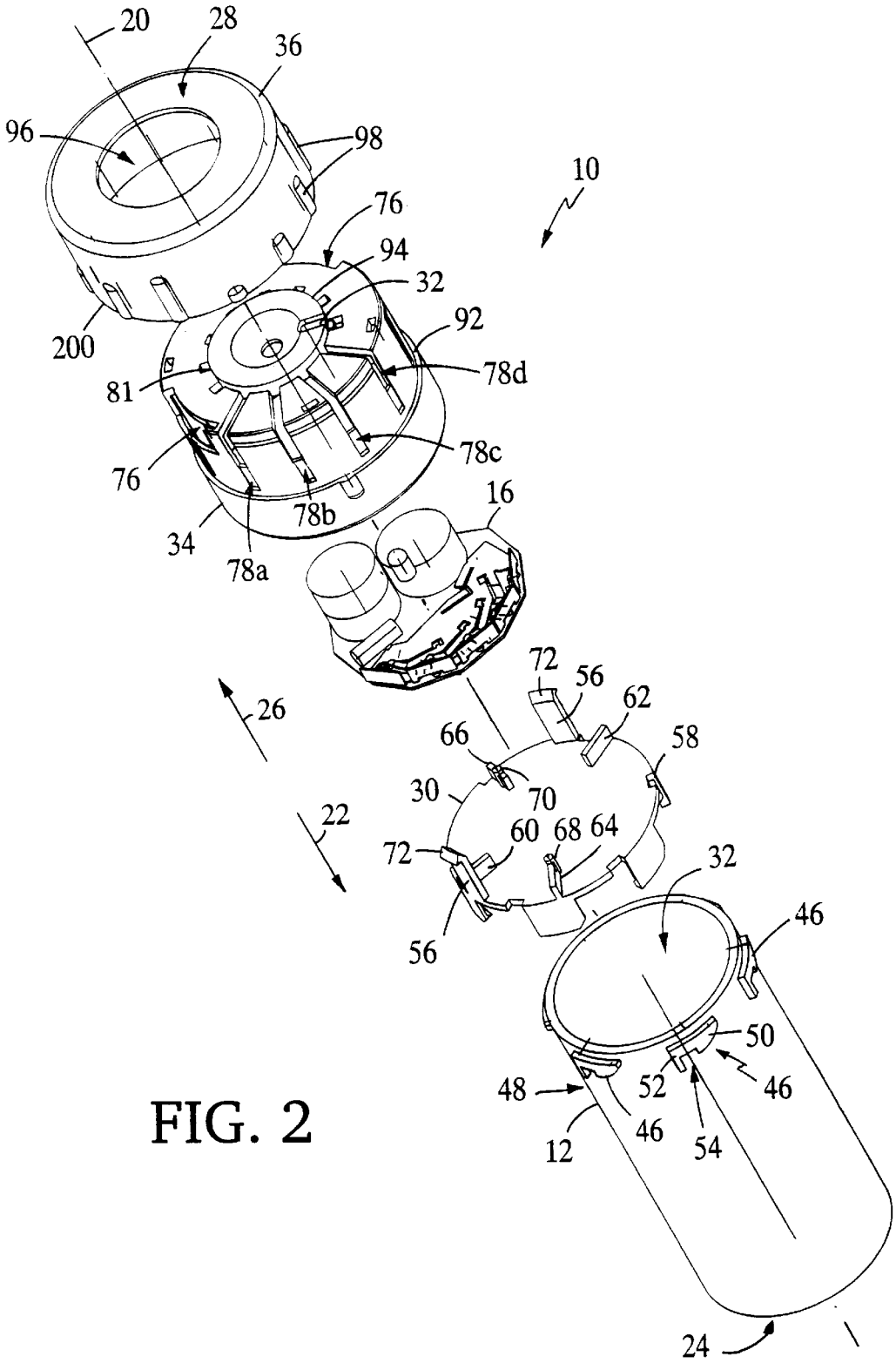
FIG. 2 is an exploded perspective view of the container of FIG. 1 exploded along a longitudinal axis extending through the cap and the container.

Referring also to FIG. 2, medication container 10 is roughly cylindrical and is disposed about a longitudinal axis 20. To provide a reference for the structure of medication container 10 relative to longitudinal axis 20, receptacle 12 is said to extend in a posterior direction 22 and is located at a posterior end 24 of container 10. Similarly, cap 14 is said to extend in an anterior direction 26 and is located nearest an anterior end 28 of medication container 10. Receptacle 12 is a hollow cylindrical member having a single opening 32 at an end nearest anterior end 28. Cap 14 is a device that attaches over opening 32 to enclose the hollow space of receptacle 12.

Figure 3:
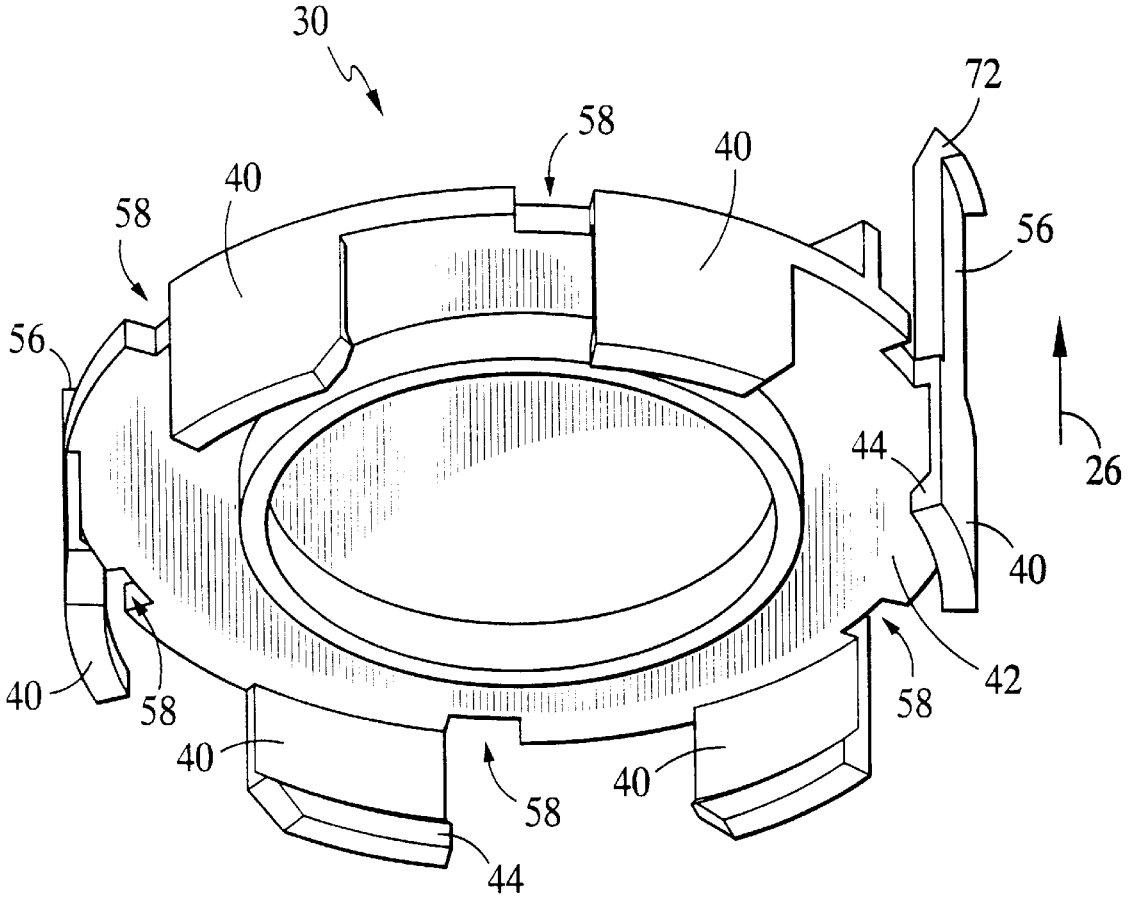
FIG. 3 is perspective view of a trigger of the container of FIG. 2 wherein a posterior side of the trigger, which is not show in FIG. 2, is shown.

In addition to timing device 16, cap 14 includes a trigger 30, a main housing 34, and an outer ring 36. Referring to FIGS. 2 and 3, trigger 30 is, in essence, a plastic (e.g., polypropylene) disk that provides a mechanism to activate or deactivate timing device 16. Trigger 30 is sized to fit within cap 14 and is, e.g., approximately 37 mm in diameter. Trigger 30 includes a set of six tabs 40 that are spaced equidistantly about the periphery of a disk section 42 of trigger 30. Each of tabs 40 is perpendicular to disk section 42 and extends in posterior direction 22. Each of the tabs 40 has a lip 44 located nearest posterior end 24.

The side of disk section 42 of trigger 30 that faces anterior end 28 includes several structures that contribute to the assembly of cap 14: two engagement arms 56, six notches 58, and four spacers 60, 62, 64, 66. When cap 14 is assembled, each engagement arm 56 extends through the inside of cap 14 in anterior direction 26 from the periphery of disk section 42. The end of each engagement arm 56 includes a hook section 72 that secures trigger 30 to main housing 34.

Disk section 42 also defines six notches 58. Each notch 58 lies in the plane of disk section 42 and is directly adjacent to a clockwise-most edge of each tab 40. When cap 14 is assembled and trigger 30 is inserted into main housing 34, each notch 58 allows one of six grips 90 of main housing 34 to pass around trigger 30.

Spacers 60, 62, 64, 66 are positioned about trigger 30 to provide a space that accommodates portions of electronic device 16, which rests on spacers 60, 62, 64, 66. Two of spacers 60, 62 are rectangularly shaped blocks extending radially to the periphery of disk section 42. The other two spacers 64, 66 are similar to spacers 60, 62 but each of spacers 64, 66 also include corresponding integrally formed alignment pins 68, 70. Alignment pins 68, 70 extend in anterior direction 26 nearest an edge of each spacer 64, 66 that is opposite the periphery of disk section 42.

Figure 4:
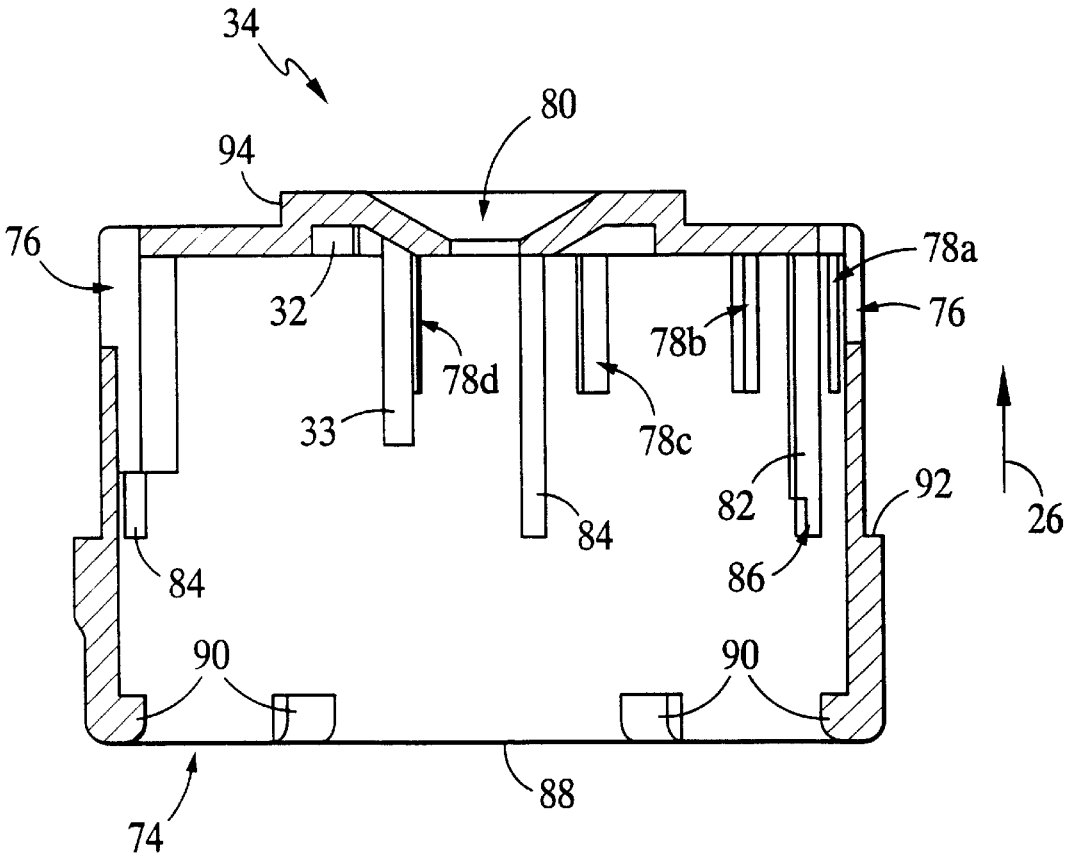
FIG. 4 is a cross-sectional side view of a main housing of the container of FIG. 2.

Referring to FIGS. 2 and 4, main housing 34 provides a mechanism to secure cap 14 in a closed position and, in combination with trigger 30, provides a mechanism to activate or deactivate alarm signals issued by timing device 32. Main housing 34 is generally cylindrical and cup-shaped having an opening 74 oriented toward receptacle 12. Main housing 34 is, e.g., 39 mm in diameter by 27 mm in height and is typically made of polypropylene.

Main Housing 34 also includes several smaller openings: two elongated openings 76, four slots 78*a*–78*d*, and one end opening 80. Elongated openings 76 extend laterally along the periphery of main housing 34 at the end of main housing 34 nearest anterior end 28. Elongated openings 76 accommodate engagement arms 56 of trigger 30 and allow the arms to slide laterally relative to main housing 34. (A fuller description of the operation of cap 14 and of the interaction of the components of cap 14 appears below.)

Slots 78*a*–78*d* provide a series of openings used to select a predetermined timing schedule. Slots 78*a*–78*d* extend along an end portion of main housing 34 nearest anterior end 28 and then continue down the side of main housing 34. Along the end portion of main housing 34, slots 78*a*–78*d* extend radially to the peripheral edge of main housing 34. Along the periphery, slots 78*a*–78*d* are spaced equidistantly and extend longitudinally.

Main housing 34 also includes anterior end opening 80 to accommodate LED 18 when cap 14 is fully assembled. End opening 80 is located in the center of the end portion of main housing 34 and is wider at an outer surface of main housing 34 than at an inner surface of main housing 34. Thus, opening 34 provides an outward-facing funnel-shaped depression that accommodates LED 18. The depression protects LED 18 from impact if, for example, medication container 10 is dropped.

Several audio ports 81 are arranged around end opening 80. Audio ports 81 are small openings that ensure cap 14 does not excessively muffle the audible alarm when cap 14 is fully assembled. When cap 14 is fully assembled, outer ring 36 fits over main housing 34, but only partially covers audio ports 81.

Adjacent to end opening 80 is a reset button 32 that is recessed inward from the outer surface of main housing 34 to protect reset button 32 from damage and inadvertent engagement. Reset button 32 is a relieved section of main housing 34 that creates a hinged tab connected to main housing 34 on one side. The reset button 32 pivots relative to main housing 34 when reset button 32 is pressed with, e.g., a pin or the tip of a pencil. Internally, a reset post 33 is connected to reset button 32 and extends downward in posterior direction 22 to engage timing device 16 when reset button 32 is pressed.

Also internally, main housing 34 includes two spacing posts 82 and four spacing posts 84. (Only one spacing post 82 and two spacing post 84 are shown because main housing 34 is cut in half in FIG. 4.) When cap 14 is fully assembled, spacing posts 82, 84 abut disk section 42 of trigger 30 to seat timing device 16 in the proper location within main housing 34. Spacing posts 82, 84 extend longitudinally along an inner surface of the periphery of main housing 34. The ends of spacing posts 82 each include right-angled notches 86 that accommodate an edge of timing device 16. Spacing posts 84 have flat ends that do not include notches.

Main housing 34 includes six grips 90 disposed along a lower peripheral edge 88. Grips 90 secure cap 14 to receptacle 12 (four grips being shown in FIG. 4). Grips 90 are spaced equidistantly about peripheral edge 88. A peripheral ridge 92 extends about the outer surface of main housing 34 and parallels peripheral edge 88. Ridge 92 abuts an edge 200 of ring 36 when ring 36 is attached to main housing 34. Similarly, a second ridge 94 forms a circular pattern on the end portion of main housing 34 that is concentric with opening 80. Second ridge 94 abuts another end of ring 36 when ring 36 is placed on main housing 34.

Figure 5:
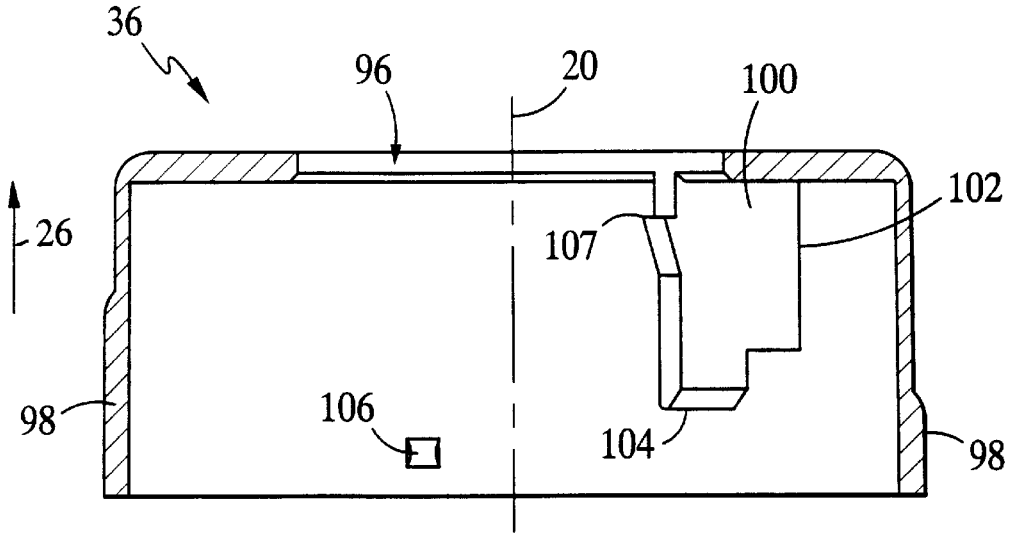
FIG. 5 is a cross-sectional side view of a ring of the container of FIG. 2.

Referring to FIGS. 2 and 5, ring 36 attaches to the outer surface of main housing 34 and covers the outer surface from peripheral ridge 92 to ridge 94. Ring 36 is, e.g., 39 mm in diameter by 10 mm in height and is typically made of polypropylene. Ring 36 includes an opening 96, ribs 98, and selection member 100. Opening 96 lies at anterior end 28 and accommodates both ridge 94 as well as opening 80 of main housing 34 when cap 14 is fully assembled.

Selection member 100, in part, provides a mechanism to select different timing schedules when ring 36 is attached to main housing 34. Selection member 100 is generally planar and extends from an inner surface 102 of ring 36 both longitudinally as well as radially inward. An end 104 of selection member 100 has a wedge shape to provide an edge to engage one of the inputs of timing device 16. Ring 36 also includes two snaps 106 (only one snap being shown in FIG. 5) on inner surface 102. Snaps 106 cooperate with the outer surface of main housing 34 to secure ring 36 to main housing 34. Selection member 100 also includes a wedge 107 that additionally secures ring 36 in place when snapped to main housing 34. Wedge 107 engages the anterior edge of one of slots 78*a*–78*d* when ring 36 is snapped onto main housing 34. The shape of wedge 107 prevents a patient from removing ring 36 from housing 34.

Ring 36 also includes three sets of ribs 98*a*–98*d* (see also FIG. 1) that extend longitudinally about the circumference of ring 36. Ribs 98*a*–98*d* provide traction when cap 14 is gripped and rotated to open or close medication container 10. In addition, ribs 98*a*–98*d* provide a visual indication of the position of ring 36 relative to main housing 34. Each rib 98*a*–98*d* can be aligned with a half-rib 99 of main housing 34, but only one rib 98*a*–98*d* can be aligned with half-rib 99 at any particular time. Each rib 98*a*–98*d* has a graduated and increasing height relative to the adjacent ribs 98*a*–98*d*, and the position of each rib corresponds to a unique timing schedule. Based on which rib 98*a*–98*d* is aligned with half-rib 99, a pharmacist can deduce which ring position, and, therefore, which timing schedule, has been selected.

Referring to FIGS. 2 and 6*a*–6*c*, in essence, timing device 16 is a timing circuit that produces an alarm signal according to the selected timing schedule. When fully assembled, timing device 16 is adapted to fit into a relatively small volume between trigger 30 and main housing 34. Timing device 16 includes a printed circuit board (PCB) 150 that serves as a structural support for electronic device 16 and that provides conductive paths and electrical contacts 222 for the timing circuit. PCB 150 is, e.g., 0.5 mm thick and has an area sized to fit on trigger 30. To conserve space, electronic components of timing device 16 are mounted to both an anterior side 152 and a posterior side 154 of PCB 150. The electronic components that are mounted to anterior side 152 include a double sized battery cell 156 to provide three volts of electrical potential, a cylindrical audio cell 158 to provide audio alarm signals, a timing crystal 160 to control clock pulse frequency, and a phosphor-bronze sheet metal contact plate 162 to provide electrical inputs to the timing circuit. The electronic components that are mounted to the posterior side 154 include an integrated circuit chip (IC) 164, a resistor 166 and three capacitors 168, 170, 172. Alternatively, ASIC technology could incorporate all resistors and capacitors within a single chip. In addition, an alternative timing device could include a single battery cell and other components mounted to one side of a PCB. Such an embodiment could be accommodated by a main housing having a smaller internal volume in an embodiment with 1.5 volts of battery electrical potential.

The electronic components mounted to PCB 150 are in electrical communication with one another via conduction paths of PCB 150, and contact plate 162 provides electrical contact switches to conduct electricity from battery cell 156 to various inputs of IC 164. The switches of contact plate 162 are ten resilient and flexible prongs: reset function prongs 174, 176, four inner timing schedule selection prongs 178, 180, 182, 184, and four outer battery contact prongs 186, 188, 190, 192. Conceptually, each of the inner timing schedule selection prongs 178, 180, 182, 184 are paired with corresponding outer battery contact prongs 186, 188, 190, 192 to provide both a "closed-position" indication signal and an electrical connection to battery cell 156 for each of four selectable timing schedules stored in IC 164. Physically, however, contact plate 162 is a single, continuous, and conductive voltage node.

To prevent undesired electrostatic discharge through timing circuit 16, those audio ports 81 that lie above battery 156 can be covered, closed, or eliminated. Thus, for example, any charge that may build up as a result of carrying medication container 10 near another electronic device may be less likely to discharge through timing circuit 16.

To operate IC 164, each of the ten contact prongs 174, 176, 178, 180, 182, 184, 186, 188, 190, 192, are depressible to engage corresponding electrical contacts 222 of PCB 150 (shown diagrammatically by the switch SW6 FIG. 6*d*) and, subsequently, to provide a conductive circuit path from battery cell 156 to one of eight electrical inputs $V_{DD}$, MCLR, RB4, RB5, RB6, RB7, RB8, and RB0 of IC 164. Each of inner selection prongs 178, 180, 182, 184 and outer battery contact prongs 186, 188, 190, 192 includes a corresponding crested section 220 that allows the prongs to be mechanically engaged by selection member 100.

Contact plate 162 further includes five peripheral plate sections 202, 204, 206, 208, 210 that extend vertically at the periphery of contact plate 162 to protect the flexible prongs. Four of plate sections 202, 204, 206, 208 also secure a permanent electrical connection between battery 156 and contact plate 162. These four plate sections 202, 204, 206, 208 each define a corresponding opening 212, 214, 216, 218 in the base of each plate section. Each corresponding opening 212, 214, 216, 218 accommodates and secures one of outer battery contact prongs 186, 188, 190, 192 against one of electrical contacts 222 of PCB 150 (shown diagrammatically by the switch SW6 of FIG. 6*d*).

When ring 36 is placed onto main housing 34, one of prongs 186, 188, 190, 192 extends through the corresponding opening 212, 214, 216, 218 and snaps into place between one of plate sections 202, 204, 206, 208 and a corresponding contact 222. The point of contact between each prong 186, 188, 190, 192 and the corresponding contact 222 electrically connects battery cell 156 for the remaining operational life of cap 14. Plate sections 202, 204, 206, 208 secure the electrical connection by providing a normal force in the direction of contacts 222.

Referring also to FIG. 6*d*, IC 164 provides the logic and processing functions required to operate medication container 10 based on the inputs received through the conductive paths of PCB 150. IC 164 is typically a 4-bit microcontroller (PIC162C554) having 128 bytes of RAM memory and 1 kilobyte of ROM memory. The operation as disclosed herein is controlled by an algorithm that is encoded in the memory of IC 164 as, e.g., a set of compiled computer instructions of an assembly language. The electrical inputs $V_{DD}$, MCLR, RB4, RB5, RB6, RB7, RB8, and RB0 are pins of IC 164.

Timing crystal 160 typically operates at a frequency of 32.678 kHz and is 3.1 mm in diameter by 8.3 mm in length.

(Smaller timing crystals are possible, e.g., 2 mm by 6 mm but tend to be more expensive than larger crystals.) Timing crystal 160 is electrically connected to two additional pins OSC1, OSC2 of IC 164 that do not connect through contact plate 162. Rather, timing crystal 160 is directly connected to IC 164. Timing crystal 160 also is electrically connected to two 47 pf capacitors 168, 170 respectively that are each connected from opposite ends of timing crystal 160 to ground 194. Alternatively, capacitors could be integrated with a timing crystal to reduce manufacturing costs.

Battery cell 156 provides an electrical potential of three volts to power audio cell 158, LED 18, and IC 164 and, additionally powers the oscillator comprising timing crystal 160 via input MCLR of IC 164. Battery cell 156 electrically connects to IC 164 at inputs $V_{DD}$ and $V_{SS}$. Audio cell 158 and LED 18 are arranged in a parallel-type fashion. Audio cell 158 electrically connects directly to battery cell 156 to provide an audio alarm signal. Audio cell 158 also electrically connects to IC 164 at an output RA2 of IC 164. Audio cell 158 is typically 12.0 mm in diameter by 8.4 mm in height and provides 80 db at 10 mA and 1.5 volts with a frequency of 2048 Hz. Battery cell 156 is in electrical communication with LED 18 through a 470 Ω resistor 166. Two 25.0 mm metallic wires 226, 228 extend LED 18 through end opening 80 and provide an electrical conduction path that electrically connects LED 18 to timing device 16 with one wire 228 connected to resistor 166 and the other wire 226 electrically connected to an output RA3 of IC 164. LED 18 extends through end opening 80 of main housing 34 to provide a visual alarm signal. LED 18 is typically 5.3 mm in length by 3.0 mm across and is red with a diffused lens.

An additional 10 μf capacitor 172 extends from the 10 volt node 196 to ground 194. Capacitor 172 reduces noise within timing device 16.

Switches SW1–SW6 of timing device 16 are diagrammatic representations of the flexible prongs of contact plate 162. When one of the switches SW1–SW6 close, a closed circuit path is provided that allows IC 164 to perform preprogrammed functions. For example, when one of the paths of SW6 is closed, battery cell 156 provides three volts of power to the electronic components. Likewise, when one of switches SW1–SW4 is closed, IC 164 provides alarm signals at the expiration of a timing interval according to the selected timing schedule. The operation of IC 154 and timing device 16 are discussed in greater detail below.

Referring to FIGS. 7*a*–7*c*, when cap 14 is assembled, timing device 16 mounts to trigger 30 which fits within main housing 34, and ring 36 fits over main housing 34. Timing device 16 mounts onto spacers 60, 62, 64, 66 of trigger 30 with alignment pins 68, 70 extending through corresponding mounting holes 230 of PCB 150 to align timing device 16 and trigger 30 (shown in FIG. 7*b*). Timing device 16 is secured with, e.g., glue. Trigger 30 mounts, with electronic device, into main housing 34. Each hook 72 of engagement arms 56 extends, from the inside outward, through one of corresponding openings 76 of main housing 34. Hooks 72 grasp the lower edge of corresponding openings 76 while the anterior surface of trigger 30 rests within notch 86 of post 82.

Ring 36 extends over main housing 34. When first assembled, ring 36 is placed into a shipping position 198 (shown in phantom) to prevent ring 36 from engaging and draining battery cell 156. When in shipping position 198, ring 36 partially extends over main housing 34 such that space exists between peripheral ridge 92 and lower edge 200. To activate, a pharmacist fully assembles and, thus, electronically activates cap 14 by snapping ring 36 to main housing 34 such that snaps 106 are engaged to secure ring 36. At that time, peripheral ridge 92 abuts edge 200 of ring 36.

In operation, medication container 10 issues alarm signals corresponding to a predetermined schedule to provide a reminder that medication should be consumed, e.g., as prescribed by a physician or as desired in the case of vitamins or other nutritional supplements. The alarm signals are a combination of a visual signal from LED 18 and a beeping sound from audio cell 158. In response to the alarm signals, a patient opens medication container 10, consumes medication, and closes medication container 10. When opened, medication container 10 resets the alarm signals and begins timing the next interval.

To secure cap 14 to receptacle 12, each of tabs 40 extends between two of six cap anchors 46 that are spaced equidistantly about an outer periphery 48 of receptacle 12 such that tabs 40 alternate between cap anchors 46. Grips 90 of main housing 34 are aligned with tabs 40 in posterior direction 22. Trigger 30 rotates relative to main housing 34. Therefore, as the pharmacist rotates cap 14 in a clockwise direction 22 (a motion that secures cap 14 in a closed-position), cap anchors 46 prevent the rotational motion of tabs 40, and, thus, grips 90 of main housing 34 rotate relative to tabs 40. Grips 90 engage corresponding wedge portions 50 of cap anchors 46 and force cap 14 toward receptacle 12 to form a tight seal. When grips 90 abut stops 52 of cap anchors 46, an opposing normal force in anterior direction 26 forces cap 14 slightly away from receptacle 12. Thus, grips 90 seat into corresponding notches 54 defined by cap anchors 46 and secure cap 14 in the closed-position while still maintaining a seal.

To remove cap 14 from receptacle 12, cap 14 is pressed slightly toward receptacle 12 and rotated counterclockwise. Grips 90 are unseated from notches 54, and cap 14 can be pulled completely away from receptacle 12 when grips 90 are again aligned with tabs 40 of trigger 30. Thus, though friction exists between moving parts of cap 14, cap 14 does not rely on friction between moving parts of cap 14 to effect the closure/opening mechanism. Rather, other types of opposing forces, such as a normal force extending from cap anchors 46 to corresponding tabs 40 in the direction opposite rotation of the cap, cause trigger 30 to rotate relative to main housing 34.

Cap 14 provides six different selectable electrical functions: a power connect function, four timing schedules, and a reset function (that also includes several subfunctions). The power connect function, which is related to shipping position 198 discussed above, connects the electronic components to battery cell 156 to activate timing device 16. When ring 36 is placed onto main housing 34, selection member 100 extends through one of four slots 78*a*–78*d* that corresponds to one of four timing schedules. As the pharmacist snaps ring 36 onto main housing 34, the end 104 of selection member 100 engages the selected one of battery contact prongs 186, 188, 190, 192 at crested section 220 and depresses the prong against corresponding one of the corresponding electrical contacts 222 of PCB 150.

Selection member 100 depresses the one of outer prongs 186, 188, 190, 192 that is conceptually paired with the selected timing schedule. Member 100 depresses the corresponding prong 186, 188, 190, 192, which partially extends through, and is held in a depressed position by, one of openings 212, 214, 216, 218 in contact plate 162. Metal contact selection member 100 deforms the corresponding prong 186, 188, 190, 192 and creates a permanent electrical contact with PCB 150. Thus, as shown diagrammatically in FIG. 6*d*, a conduction path is provided from the low voltage side of battery cell 156 to contact plate 162 through one of battery contact prongs 186, 188, 190, 192 once the pharmacist activates timing device 16 by snapping ring 36 to main housing 34.

Cap 14 also provides four timing schedules that are selected by inserting member 100 of ring 36 through one the four slots 78*a*–78*d*. The selected position of ring 36 represents one of the four schedules. Before snapping ring 36 to main housing 34, the pharmacist inserts selection member 100 into one of the four slots 78*a*–78*d*. Slot 78*a* corresponds to a once per day timing schedule 260, i.e., timing device 16 provides an alarm signal once every 24 hours. Similarly, slots 78*b*–78*d* respectively correspond to twice per day, three times per day, and four times per day timing schedules 262, 264, 266. When on the twice per day schedule 262, timing device 16 issues an alarm signal every twelve hours. When on the three times per day schedule 264, timing device 16 issues alarm signals at the end of three daily timing periods of ten hours, seven hours, and seven hours respectively. When on the four times per day schedule 266, timing device 16 issues alarm signals at the end of four daily timing periods: one period of ten hours, and three periods of four hours and forty minutes each.

After the pharmacist selects one of the timing schedules by snapping ring 36 to main housing 34, cap 14 issues one beep and one flash to indicate that cap 14 is operational. Subsequently, the pharmacist implements the timing schedule by securing cap 14 to receptacle 12, i.e., by placing cap 14 in the closed-position. Each time cap 14 is placed in the closed position, whether by the pharmacist or by the patient during use, cap 14 issues one beep and one flash to indicate both that cap 14 is operating and is closed onto receptacle 12.

When in the closed-position, shown in FIG. 6*b*, selection member 100 engages the inner timing schedule prong 178, 180, 182, 184 that corresponds to the selected slot 78*a*–78*d* and, thus, provides a conduction path from contact plate 162 to IC 164 that is unique to the selected timing schedule. In other words, as shown diagrammatically by switches SW1–SW4 of FIG. 6*d*, each of the four timing selection prongs 178, 180, 182, 184 corresponds to one of inputs RB4, RB5, RB6, RB7 of IC 164 to select one of the four timing schedules. Closing medication container 10 and, thus, depressing one of prongs 178, 180, 182, 184 with selection member 100 is equivalent to closing one corresponding switch SW1–SW4.

The structure of cap 14, for example, the slots 78*a*–78*d* in main housing 34, preclude any of the remaining three of prongs 178, 180, 182, 184 that correspond to unselected timing schedules from ever being engaged by selection member 100. Thus, unless temporarily closed by, e.g., a sudden jarring motion, the remaining three prongs will not be in a closed position. Also, even if the remaining three prongs 178, 180, 182, 184 are in a closed position, cap 14 accepts inputs from only the initially selected prong.

As medication container 10 is closed, trigger 30 rotates relative to main housing 34. While closing, selection member 100 sweeps over the corresponding one of timing selection prongs 178, 180, 182, 184 in a clockwise direction and engages crested section 220 to force the prong against one of electrical contacts 222 of PCB 150. The amount of sweep is limited to 230 by openings 76 of main housing 34 which limit the rotation of trigger 30 relative to main housing 34. Openings 76 extend peripherally a distance that constrain engagement arms 56 of trigger 30 within a range of 23° of rotation. Each opening 76 extends angularly about the periphery of main housing 34 for 23° and further extends an additional angular distance, e.g., 6°, to accommodate the width of one engagement arm 76.

Thus, the structure of cap 14 limits the possible relative positions of the constituent parts within the 23° range. Thus, when in the closed-position, grips 90 are seated in corresponding notches 54; engagement arms 76 are located at a clockwise-most end of openings 76; and selection member 100 engages crested section 220 of one of prongs 178 180, 182, 184. When in an open-position, grips 90 are aligned with corresponding tabs 40 in posterior direction 22; engagement arms 76 are located at a counterclockwise-most end of openings 76; and selection member 100, which has a relative location of 23° counterclockwise to the closed-position location of selection member 100 (shown in phantom as 224 in FIG. 7*b*), does not engage any of timing schedule selection prongs 178, 180, 182, 184.

The reset function of cap 14 incorporates several subfunctions, e.g., four operating modes and a patient reset subfunction, that are all implemented by pressing reset button 32 of main housing 34. As seen in FIG. 6*b*, the lower end of reset post 33 is directly adjacent to reset prongs 174, 176. When reset button 32 is pressed, reset post 33 depresses one of reset prongs 174, 176 against one of the contacts of PCB 150. Thus, as shown diagrammatically in FIG. 6*d*, when reset button 32 is pressed, switch SW5 is closed to conduct electricity from battery cell 156 through input RBO of IC 164.

Post 33 rotates relative to prongs 174, 176 as cap 14 is opened and closed. When cap 14 is in the open-position, reset post 33 aligns with and depresses prong 174. When cap 14 is in the closed-position (as shown in FIG. 7*b*), reset post 33 aligns with and depresses prong 176. However, when depressed, both prongs 174, 176 provide a conduction path from battery cell 156 to input RBO of IC 164.

Referring to FIG. 8, the operating modes associated with reset button 32 are implemented by repetitiously pressing reset button 32. Before timing device 16 is placed in the closed position, but after timing device 16 is electronically activated, there are four possible modes. First, a normal mode 250 is the default mode of timing device 16 and is intended as the typical setting. Timing device 16 issues a single beep to signify normal mode was selected.

In normal mode 250, cap 14 repeats a five minute cycle until medication container 10 is opened, and cap 14 is reset. Initially, five beeps issue over a period of five seconds. Subsequently, cap 14 issues a series of flashes, one flash every two seconds, for 295 seconds. After five minutes (300 seconds), cap 14 repeats the cycle. For all modes, flashes are 0.2 seconds in duration with 1.8 seconds between each flash; beeps are 0.5 seconds in duration with 0.5 seconds between beeps; and cap 14 does not simultaneously issue both flashes and beeps. Alternatively, a three minute cycle could be selected as well as other beep and flash lengths.

Second, an active mode 252 is selectable by pressing reset button 32 once. Timing device 16 issues two beeps to signify active mode 252 is selected. Active mode 252 provides additional alarm signals for, e.g., elderly patients who may be hard of hearing or patients who may require additional reminders. In active mode 252, cap 14 uses a one minute cycle rather than a five-minute cycle. Cap 14 issues three initial beeps over a period of three seconds. Subsequently, cap 14 issues a series of visual flashes for 57 seconds. As with normal mode 250, cap 14 repeats the cycle until cap 14 is reset.

Third, a discrete mode 254 is selectable by pressing reset button 32 twice. Timing device 16 issues three beeps to signify discrete mode 254 is selected. Discrete mode 254 provides fewer alarm signals for, e.g., patients taking sensitive medications. Discrete mode 254 allows a patient to be quickly notified without undue attention. In discrete mode 254, cap 14 uses a five-minute cycle. Initially, cap 14 issues one beep over a one-second duration. Subsequently, cap 14 issues a series of flashes for 299 seconds. Cap 14 repeats the cycle until cap 14 is reset.

Finally, a demonstration mode is selectable by pressing reset button 32 three times. Timing device 16 issues four beeps to signify demonstration mode is selected. Demonstration mode provides the pharmacist with a unit for demonstrating the operation of medication container 10 to patients. Demonstration mode also allows medication container 10 to operate indefinitely, i.e., until power is exhausted as opposed to a predetermined number of days.

The four modes are consecutively selectable. For example, if reset button 32 is pressed a fourth time, normal mode is selected again and one identifying beep will be issued. If reset button is pressed a fifth time, active mode is selected again and two identifying beeps will be issued. Further, the pharmacist permanently selects a mode by closing medication container 10 to engage the selected timing schedule. At that time, the unselected modes become unselectable in the future. Thus, a patient can not alter the mode after first receiving medication.

After the pharmacist selects a mode and engages the selected timing schedule, reset button 32 provides an additional reset subfunction to the patient. The reset function allows the patient to synchronize the timing schedule with the patient's schedule. For example, pressing the reset button 32 alters the timing schedule to a predefined point in the cycle: to the start of the 24-hour cycle for the once-per-day schedule, to the beginning of a twelve hour cycle for the twice-per-day schedule, and to the beginning of a ten-hour cycle for the three-times-per-day and four-times-per-day schedules.

The reset subfunction remains available throughout the operational life of cap 14 to allow the patient to alter the synchronization of the timing schedule. The timing schedule is initiated when the patient first opens cap 14. However, cap 14 is designed to allow the patient to synchronize the selected timing schedule to a time when the patient retires to sleep. When the reset subfunction is engaged, cap 14 will not issue an alarm for ten hours. The reset subfunction causes cap 14 to time a ten-hour timing interval and issue an alarm signal at the expiration of the ten-hour timing interval. At that point, cap 14 begins timing from the start of the selected timing schedule 260, 262, 264, 266. Alternatively, the reset subfunction could be designed to allow the patient to synchronize cap 14 upon waking, or cap 14 could execute both features simultaneously depending on which prong 174, 176 is depressed.

In addition to the selectable operating modes, medication container 10 has several automatic modes that augment the performance of medication container 10. For example, medication container 10 functions for 36 days, and, after that time, timing device 16 no longer issues an alarm signal. The 36-day period is initiated by the patient when the patient first opens medication container 10 to take the first dose of a prescription. Thus, the patient can purchase simultaneously several prescriptions and delay the start of the operational duration of the attached cap 14 until the medication is required.

The operational duration of medication container 10 is compatible with existing Food and Drug regulations which set a maximum prescription duration of 34 days before a refill is required. For a monthly prescription, medication container 10 operates for the 34-day duration, but provides two additional days of operation. The additional days accommodate some noncompliance with the regulations and allow a patient to consume any additional medication in receptacle 12 according to the prescribed timing schedule. In addition, as discussed above, the duration of operation of medication container 10 is not limited to a specific number of days when medication container 10 operates in demonstration mode; the duration is limited only by the energy available from battery cell 156.

Medication container 10 includes an alarm signal preempt mode that resets the alarm signal when the medication is taken within a predetermined time prior to the alarm signal, e.g., within a subinterval of one-half of the current timing interval (i.e., within 6 hours if a twelve hour timing interval is the current interval of the timing schedule). If the timing schedule causes timing device 16 to issue an alarm signal at 9:30 a.m. but the patient takes the medication earlier at 8:30 a.m., timing device 16 will not issue the scheduled alarm signal. Rather, timing device 16 will issue the next alarm signal upon the expiration of the subsequent timing interval, e.g., 9:30 p.m. that evening when twice per day schedule 262 is selected.

Medication container 10 further includes a mute mode that precludes timing device 16 from issuing the audible alarm signal when cap 14 is removed from receptacle 12. Thus, medication container 10 can be disposed prior to the expiration of the 36-day duration of operation without timing device 16 issuing an audible alarm signal from, e.g., a garbage receptacle. However, timing device 16 continues to issue the visual alarm signal, which will continue for three days or until cap 14 is manipulated to reset the alarm signal. In addition, timing device 16 continues to track the time. Therefore, if the alarm signal is reset, the mute mode will cease to allow the patient to resume normal operation. Alternatively, all alarm signals could cease, or a period other than three days, e.g., five days, could be used.

Figure 9A:
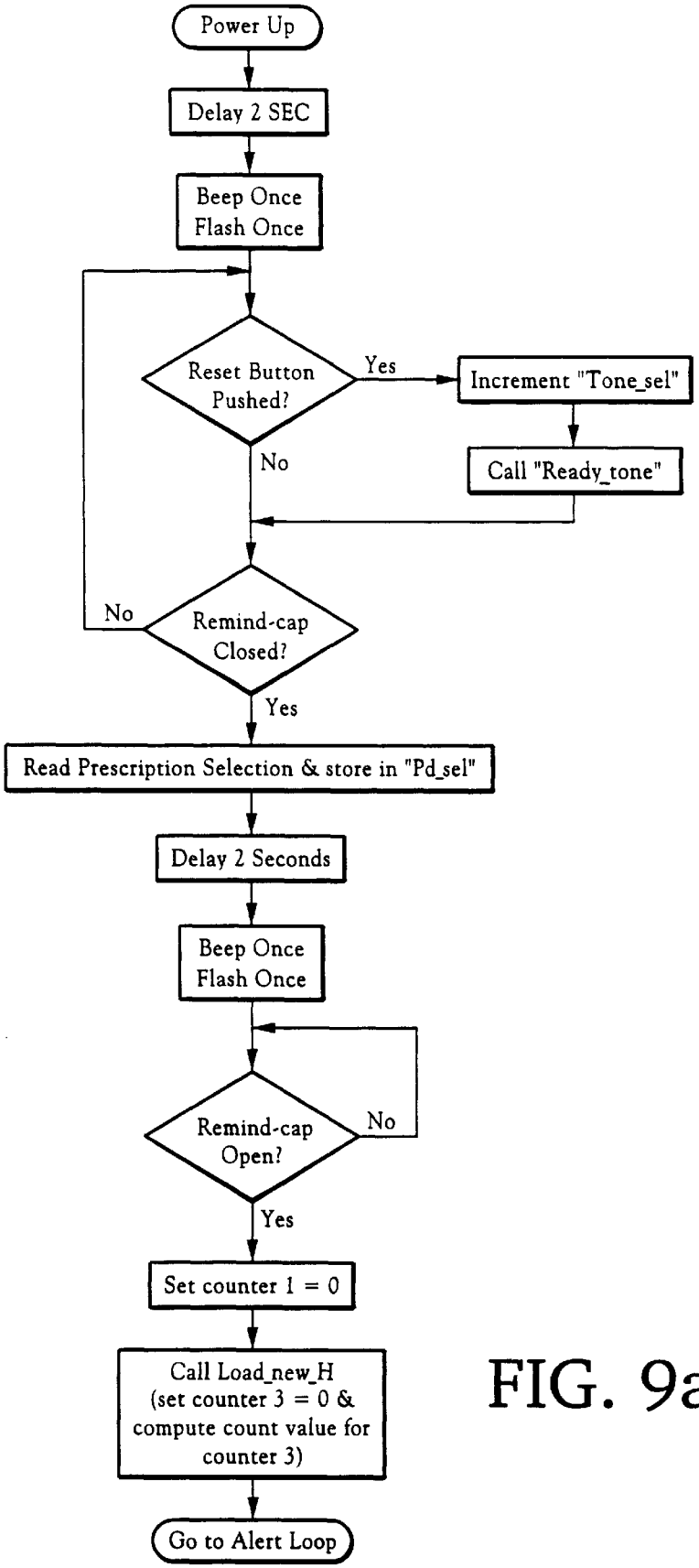
Figure 9B:
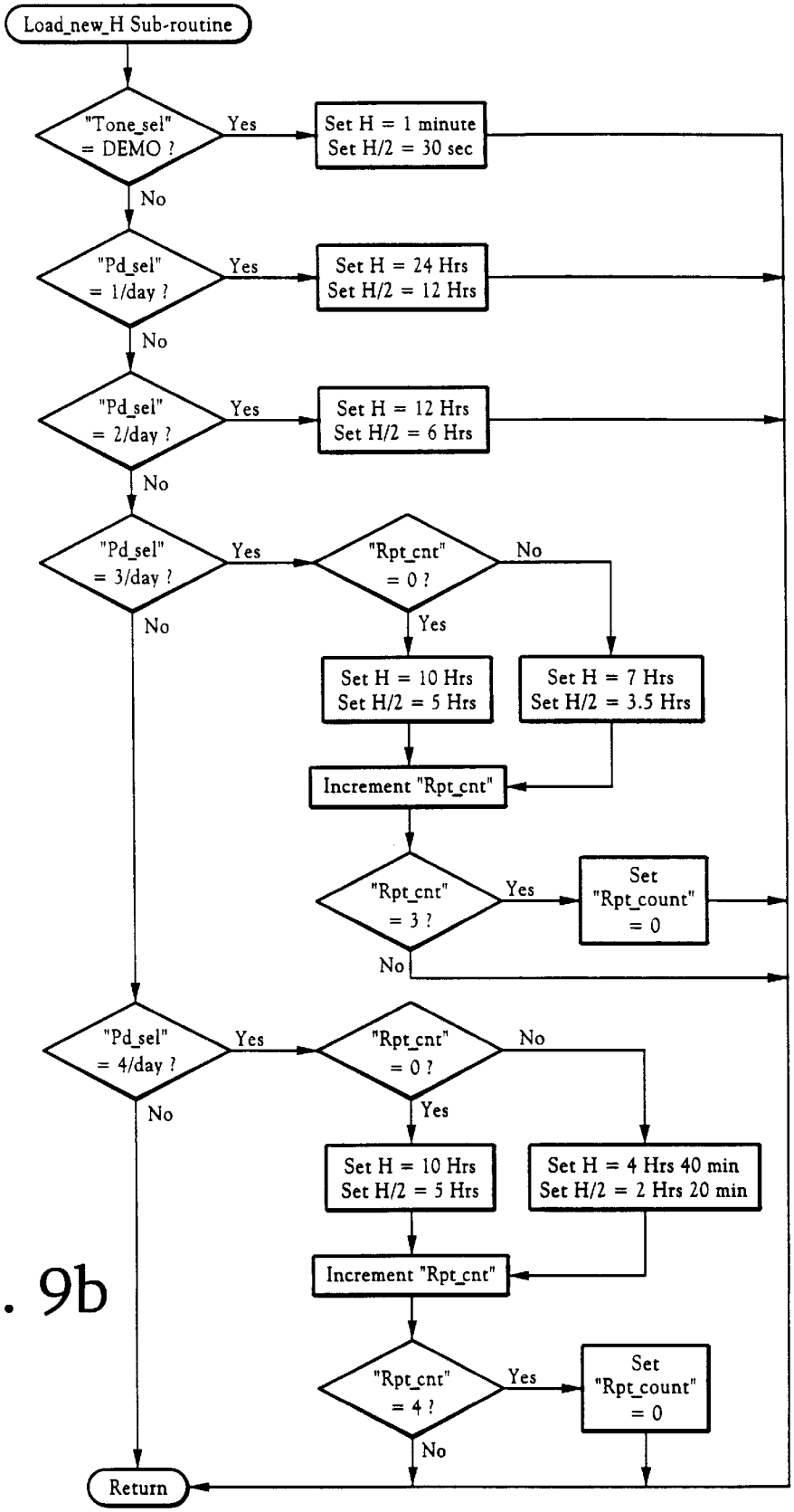
Figure 9C:
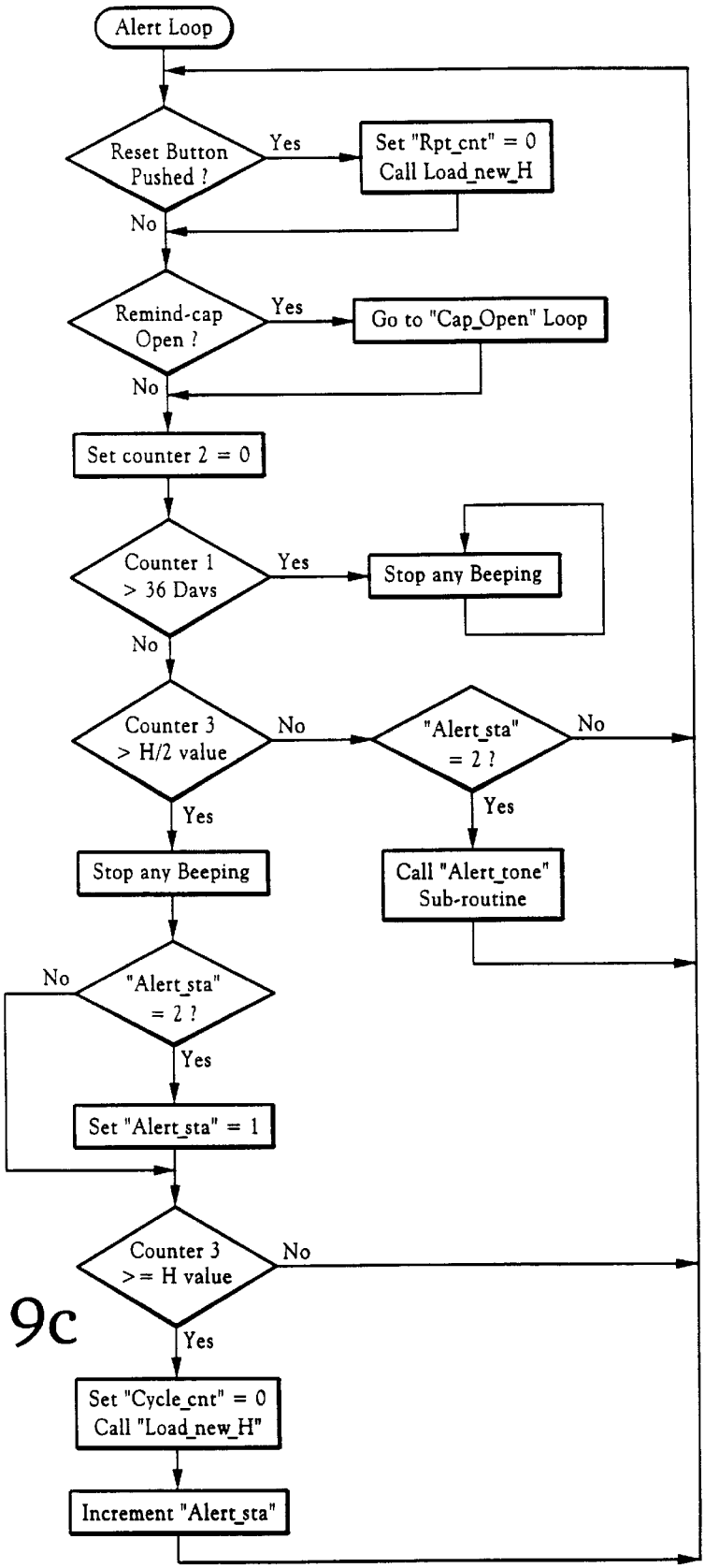
Figure 9D:
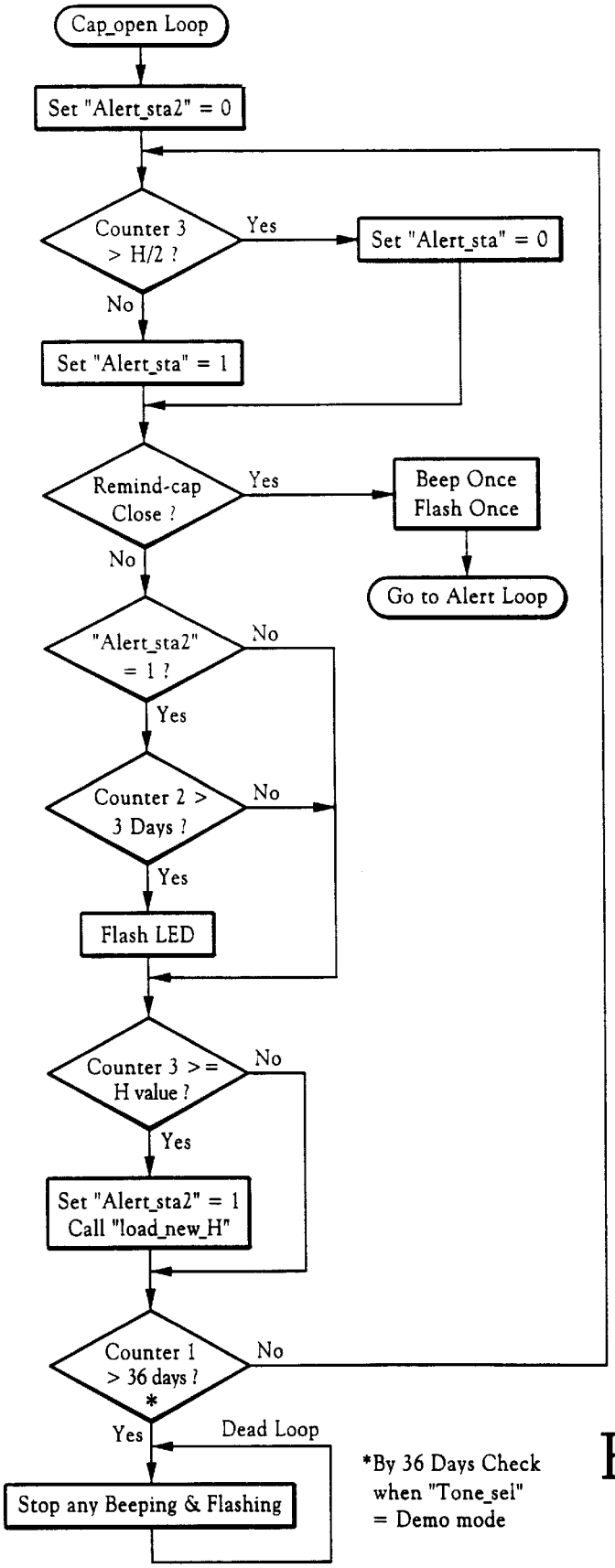
Figure 9E:
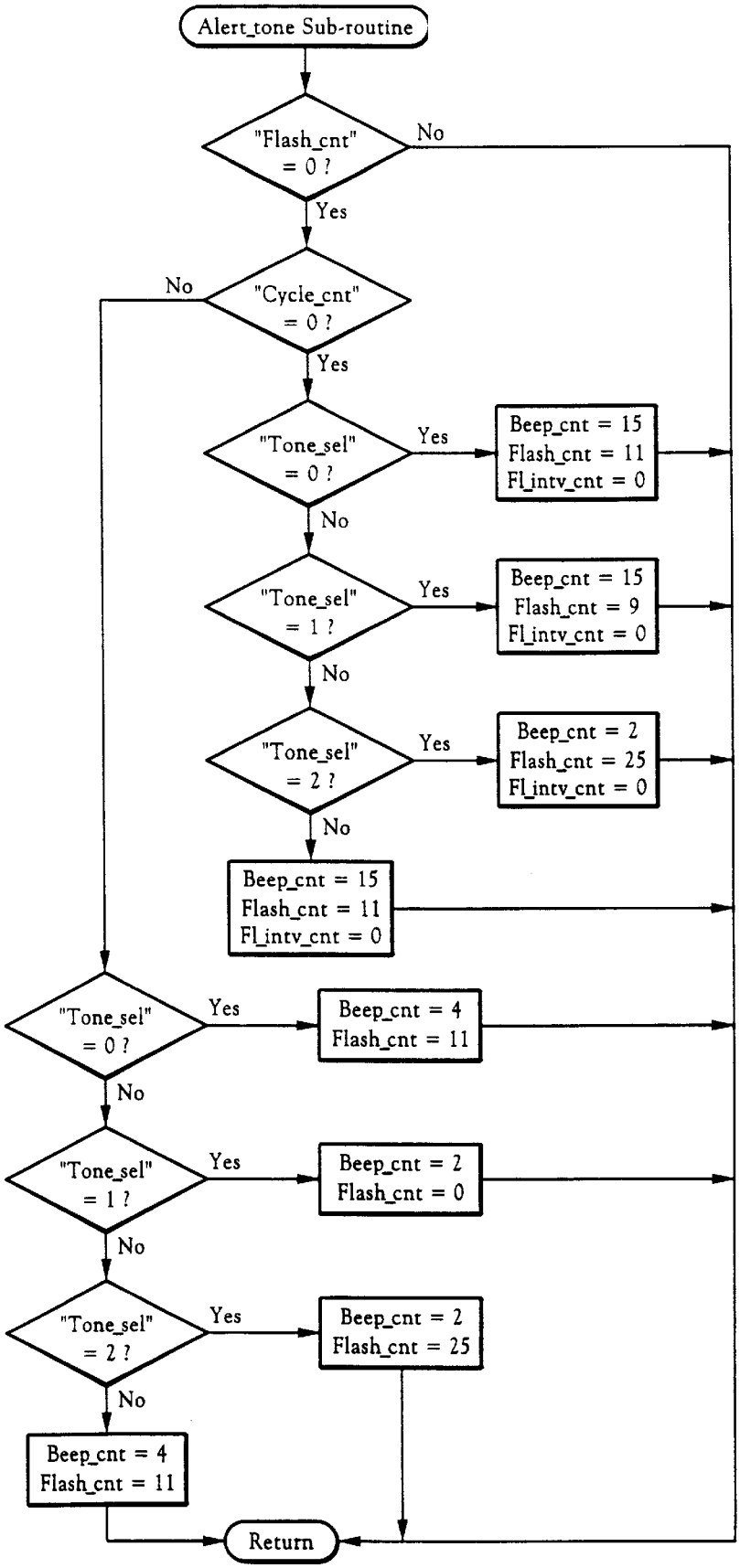
Figure 9F:
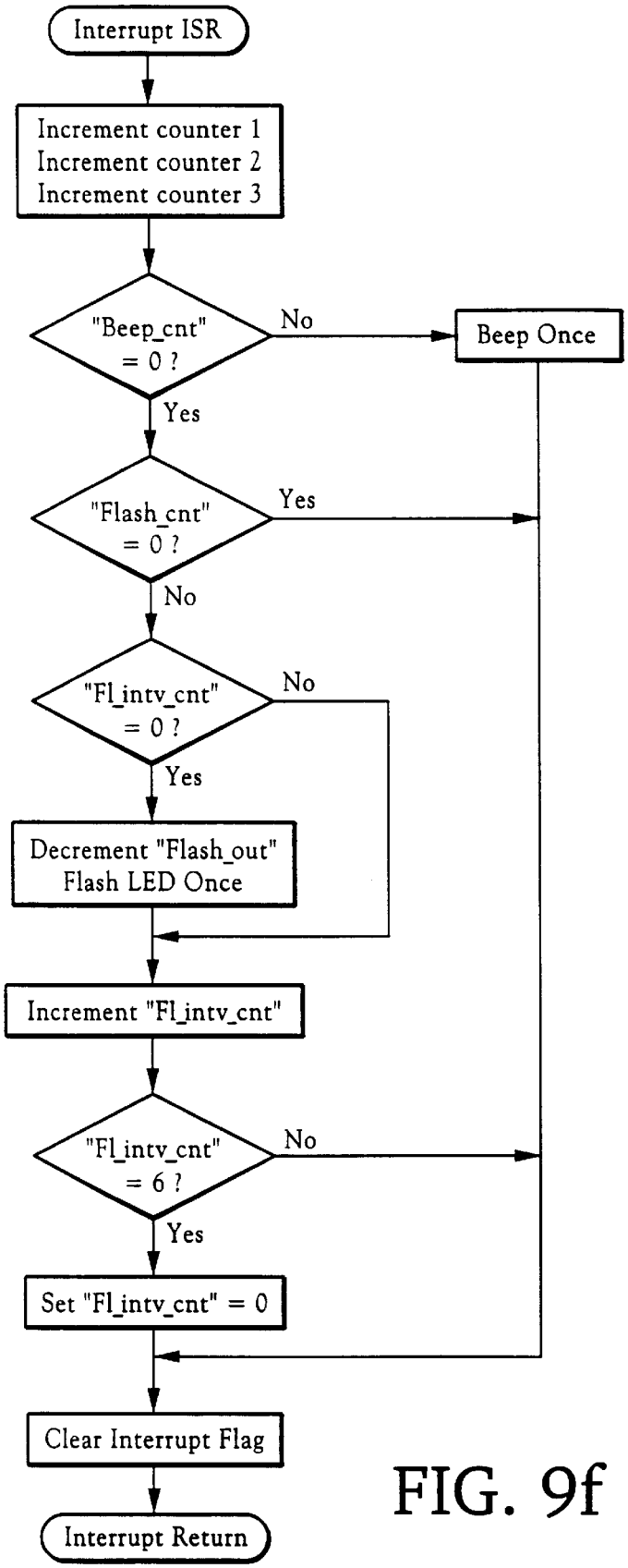

One embodiment of the logic that IC 164 can employ is illustrated in FIGS. 9*a*–9*c*. IC 164 stores the logic in the memory of IC 164 as a set of subroutines that cause cap 14 to perform the functions as indicated.

Other embodiments are within the scope of the following claims.

Medication container 10 is an embodiment of a child-resistant container. However, referring to FIGS. 10–13, medication container 300 is a flip-cap-type container. Medication container 300 includes generally the same components as medication container 10. However, the mechanism for indicating the open and closed positions of a cap 314 relative to a receptacle 312 is different from that of medication container 10. In addition, the mechanism for opening and closing medication container 300 is different.

Cap 314 does not rotate to a closed position. Though, cap 314 includes a main housing 334 that has a structure that is nearly identical to main housing 34 of cap 14, main housing 334 includes a lip 390 that snaps over the catches of standard receptacle 312. Lip 390 essentially replaces grips 90 of main housing 34. Cap 314 also includes a trigger 330 that is similar to trigger 30 of cap 14, but trigger 330 does not rotate relative to a main housing 334. Therefore, to prevent rotation, trigger 330 includes two engagement arms 356 that are sized to completely occupy the width of two corresponding openings 376 of main housing 334. Thus, arms 356 abut both sides of each corresponding opening 376, and trigger 330 does not rotate relative to main housing 334.

In addition, trigger 330 does not include tabs 40 because trigger 330 does not require a structure to rotate trigger 330 relative to main housing 334. Rather, trigger 330 includes a sealing lip 316 that extends into receptacle 312 directly adjacent to the inner wall of the receptacle. Lip 316, in part, seals container 300 which does not require plug seal liners that typically are used with child proof containers.

To indicate cap 314 is in an open or a closed position, cap 314 includes an additional metal contact 302 that extends across a portion of the upper surface of trigger 330. Contact 302 has a hooked portion 304 that aligns with an opening 306 of trigger 330. Opening 306 is essentially a rectangular notch at the periphery of trigger 330. Hooked portion 304 is a bulbous structure that is disposed within opening 306. When cap 314 is placed on receptacle 312, an upper edge 308 of receptacle 312 forces hooked portion 304 against a contact 310 on a PCB 350 of cap 314. When cap 314 is removed from receptacle 312, the upper edge 308 allows hooked portion 304 to spring back to the original position.

PCB 350 is similar to PCB 150. However, the posterior side of PCB 350 includes the contact point 310 that is aligned with hooked portion 304 to provide an electrical connection between metal contact 302 and PCB 350. A second metal contact 362 is attached to the anterior side of PCB 350 and is in electrical contact with contact 302 through PCB 350. Thus, hooked portion 304 performs essentially the same function as the four inner prongs 178, 180, 182, 184 of cap 14 by completing the timing circuit and indicating whether cap 314 is in the open or closed position.

Contact 362 is similar to contact 162 of cap 14. However, contact 362 does not include vertical plates or a set of outer prongs. Rather, because metal contact 302 provides an indication of cap position, inner prongs 378, 380, 382, 384 are not required to perform that function and are used instead to provide an electrical connection to a battery 356. A ring 336 of cap 314 is similar in structure and function to ring 36 of cap 14. Ring 336 is placed on main housing 334, and a timing pattern selection member similar to member 100 (FIG. 5) is aligned with and engages one of prongs 378, 380, 382, 384. As with the prongs of cap 14, each prong 378, 380, 382, 384 corresponds to one of four timing schedules. Ring 336 is used to select one of the timing schedules in the same manner as with cap 14. However, unlike cap 14, the selection member engages prongs 378, 380, 382, 384 continuously throughout the operational life of cap 314.

Though the mechanism that indicates whether cap 314 is in an open and closed position is different from the mechanism of cap 14, the functions and timing schedules of both caps 14, 314 are essentially the same. In addition, because trigger 330 does not rotate relative to main housing 334, cap 314 requires only one contact prong 376 to provide the reset subfunctions.

Alternatively, a cap having a mechanism similar to the mechanism of cap 314 could be constructed for a medicine container having a screw-cap, such as is used for vitamin containers or another type of rotating cap, such as a child-resistant cap. Also, a snap-cap or screw-cap could include multiple hooked portions 304, e.g., three hooked portions 304 arranged equidistantly about the periphery of a trigger in corresponding openings. Such an arrangement could increase the integrity of the mechanism, for example, when the cap is misaligned such that the edge of a receptacle does not abut all portions of the trigger. Such misalignment could preclude an indication that the cap is in the closed position even though the cap appears to the patient to be closed.

Referring to FIGS. 14–16, a medication container 400 is similar to medication container 10. Like medication container 10, medication container 400 includes a rotating child-resistant cap 414 that utilizes nonfrictional normal forces. However, unlike cap 14 of medication container 10, cap 414 includes a timing device 416 that does not rotate relative to a main housing 434. In cap 414, timing device 416 (FIG. 18) is mounted directly to main housing 434 rather than to a trigger 430 of cap 414 (FIG. 17). Therefore, timing device 416 remains in a stationary position relative to main housing 434, and trigger 430 rotates relative to both timing device 416 and main housing 434.

To secure timing device 416 and provide the proper spacing for both timing device 416 and trigger 430, main housing 434 includes two types of spacing posts 482, 484. Spacing posts 482, 484 extend along the inner surface of main housing 434 in the longitudinal direction. When cap 414 is fully assembled, each spacing post 482, 484 extends through a complementary slot 454 in the periphery of a PCB 450 of timing device 416. Thus, each spacing post 482, 484 secures timing device 450 in the direction of rotation. In addition, spacing posts 482 include a notch 486. The anterior surface of PCB 450 abuts notch 486 when cap 414 is fully assembled. Thus, spacing posts 482 support timing device 416 and prevent timing device 416 from moving in the anterior longitudinal direction.

In addition, main housing 434 contains two arms 488 that are similar to engagement arms 56 of trigger 30. Each arm 488 extends longitudinally within main housing 434 and terminates in a hooked portion 490. Each hooked portion 490 extends through a complementary opening in the periphery of PCB 450. Hook portions 490 support timing device 416 and prevent timing device 416 from moving in the posterior longitudinal direction. Acting in combination, spacing posts 482, 484 and arms 488 ensure that timing device 416 is secured in a predetermined position between main housing 434 and trigger 430.

Referring also to FIG. 17–18, trigger 430 is similar to trigger 30 (FIG. 2), but trigger 430 has only one engagement arm 458 whereas trigger 30 has two engagement arms 58. In addition, trigger 430 includes a resilient metal contact 402 and an integrally formed fastener 406. Fastener 406 attaches metal contact 402 to the anterior surface of trigger 430 by extending around three edges of metal contact 402. When cap 414 is fully assembled, metal contact 402 slopes upward from trigger 430 to the posterior side of PCB 450. An end 404 of metal contact 402 engages PCB 450. End 404 forms a T-shaped structure that has two dimples 412 on either side oriented toward PCB 450. Each dimple 412 contacts PCB 450.

Metal contact 402 acts as an electronic switch for timing device 416. End 404 provides a conductive path that bridges two electrical contact points 410 of PCB 450. When cap 414 is closed, each dimple 412 contacts the posterior side of PCB 450 but does not engage the electrical contact points 410. When cap 414 is opened, each dimple 412 slides along the posterior side of PCB 450 and aligns with both metal contact points 410. When dimples 412 abut contact points 410, metal contact 402 forms a conductive path between contact points 410. Thus, as shown diagrammatically in FIG. 19, metal contact 402 acts as an electrical switch SW7 to indicate whether cap 414 is in an open or closed position. Switch SW7 opens when cap 414 is in the closed position, and closes when cap 414 is in the open position.

PCB 450 includes a second metal contact 462 that lies along the anterior surface of PCB 450. Metal contact 462 includes four prongs 474, 476, 478, 480 that are also T-shaped and that are aligned above corresponding pairs of electrical contact points 410. One electrical contact point 410 of each pair is electrically connected to a battery 456 of timing device 416. The other electrical contact point 410 of each pair is electrically connected to an IC 464.

As with the prongs of cap 14, each prong 474, 476, 478, 480 corresponds to one of four timing schedules. When any one of the four prongs 474, 476, 478, 480 is depressed against the corresponding pair of metal contacts 410, battery 456 is engaged to power timing device 416, and the associated timing selection pattern is selected. As shown diagrammatically in FIG. 19, each prong acts as an electrical switch SW6 to engage battery 456, and also acts as a corresponding timing pattern selection switch SW1, SW2, SW3, or SW4.

Metal contact 462 also includes a single reset prong 408 that functions in a manner similar to reset prong 376 of cap 314 (FIG. 13). Because timing device 416 does not rotate relative to main housing 434, a second reset prong is not required.

Timing device 416 also includes an additional input prong 468 that provides a second indication of the position of cap 414, i.e., whether cap 414 is in the open position or the closed position. Prong 468 has an L-shaped profile that extends longitudinally through an opening 466 in PCB 450. Prong 468 is aligned with a wedge 464 of trigger 430. When cap 414 is in the open position, prong 468 abuts an electrical contact point 410 of PCB 450. When cap 414 is moved to the closed position, wedge 464 slides underneath prong 468 and pushes prong 468 away from electrical contact point 410. Thus, as shown diagrammatically in FIG. 19, prong 468 acts as a switch SW8 that is open to indicate that cap 414 is closed and that is closed to indicate that cap 414 is open.

Referring to FIGS. 15, 16 and 20, a ring 436 of cap 414 is similar in structure and function to ring 36 of cap 14. Ring 436 is placed on main housing 434. A timing pattern selection member 492, which is similar to member 100 (FIG. 5), is aligned with one of prongs 474, 476, 478, 480 and depresses that prong when the pharmacist snaps ring 436 into the locked position. Ring 436 is used to select one of the timing schedules in the same manner as with cap 14. However, selection member 492 engages prongs 474, 476, 478, 480 continuously throughout the operational life of cap 414.

Additionally, cap 414 can be configured into a shipping position that allows ring 436 of cap 414 to be placed more securely onto main housing 434. When ring 436 is in the shipping position, cap 414 has a relatively low profile, is secured to main housing 434, and does not require removal to select a timing schedule.

To configure cap 414 into the shipping position, four timing selection slots 472*a*–472*d* of main housing 434 extend along a stair-shaped surface 470 of main housing 434. When ring 436 is placed on main housing 434, selection member 492 extends into, and can move within, the space above stair-shaped surface 470. Stair-shaped surface 470 extends 90 degrees about main housing 434 in the rotational direction. Thus, the pharmacist can rotate selection member 492 to each of the four slots 472*a*–472*d* without removing ring 436 from the shipping position.

Two sets of snaps, upper snaps 446 and lower snaps 448, extend about the outer circumference of main housing 434. Upper snaps 446 and lower snaps 448 are 4.0 mm apart in the longitudinal direction. A complementary lip 452 extends about the inner circumference of ring 436. Upper snaps 446 secure cap 414 in the shipping position. Lip 476 is snapped over upper snaps 446 during assembly to place cap 414 in the shipping position. Subsequently, to select a timing schedule and activate cap 414, the pharmacist snaps lip 452 over lower snaps 448. Lower snaps 448 are wedge-shaped to prevent the patient from unsnapping ring 436 from main housing 434 after a timing schedule is selected.

Ring 436 includes a visual selection mechanism that is similar to ribs 98*a*–98*d* of ring 36 (FIG. 1). In addition, ring 436 includes a detente selection mechanism that provides a touch indication of the position of ring 436 relative to main housing 434. The detente selection mechanism is an indicator post 494 that extends below the posterior edge of selection member 492. When ring 436 is in the shipping position and the pharmacist rotates the ring, indicator post 494 passes adjacent to each timing selection slot 472*a*–472*d*. When indicator post 494 passes between any two slots 472*a*–472*d*, the pharmacist feels some slight friction. When indicator post 494 passes across any slot 472*a*–472*d*, the pharmacist feels indicator post 494 seat into that slot.

The end of each slot 472*a*–472*d* includes a complementary shallow groove 496. Thus, when the pharmacist snaps ring 436 down to the locked position, indicator post 494 slides into the selected shallow groove and, thus, does not obstruct ring 436 from entering the locked position.

Cap 414 has several additional features. Main housing 434 includes a reset post 433 that has a rectangular cross section and a tapered posterior end. Post 433 may have improved reliability when operating the reset prong and the associated functions and subfunctions.

Main housing 434 also includes an LED alignment mechanism 420 that aligns LED 418 with an anterior end opening 422. Alignment mechanism 420 is a set of three slides 420*a*–420*c* that extend radially and equidistantly from end opening 422 along the interior of main housing 434. Slides 420*a*–420*c* are sloped to direct LED 418 into opening 422 when cap 414 is assembled.

Referring to FIG. 17, trigger 430 includes six tabs 440. Each tab 440 includes a notch 442 in the lower corner. Each notch 442 accommodates a corresponding grip 444 of main housing 434 when cap 414 is in the open position. Thus, the combined width of each tab 440 and grip 444 is constant when cap 414 is attached to and removed from receptacle 12.

The functions and timing schedules of cap 414 are the same as those of caps 14 and 314, but, as with all three caps 14, 314, 414, other schedules and functions can be incorporated.

As disclosed above, the term medication container pertains to containers for prescribed medications. However, the medication containers are exemplary embodiments of a generic container that is within the scope of the claims and that includes additional types of containers, for example, containers for vitamins, other nutritional supplements, non-prescription medications (such as aspirin or allergy medications), pet medications or foods, and other containers that contain items to be consumed or disposed according to a predetermined schedule.

Similarly, the term pharmacist is used as a specific example of a person who selects the predetermined timing schedule and activates cap 14. The term patient is used as a specific example of a person who uses the contents of medication container 10. However, other examples are possible and, to utilize some embodiments within the scope of the claims, one person could assume both roles.

Medication container 10 includes a mechanical trigger 20 that, in essence, senses whether the container is open or closed and, in response, selectively engages and disengages the inputs of timing device 16 by a mechanical mechanism. However, other mechanisms are possible, including electronic mechanisms and mechanisms that are partially mechanical and partially electronic. For example, to provide an electrical mechanism, a photo electric sensor could be placed on the posterior surface of the cap such that the sensor is enclosed in the receptacle when the cap is attached to the receptacle. Thus, assuming the receptacle is sufficiently opaque, the sensor would typically receive relatively less light when the cap is closed than when the cap is open. A partially mechanical and electronic sensor could include a conductive foil around the edge of the receptacle that completes an electrical circuit when the cap is attached to the receptacle and engages the conductive foil.

Other mechanisms are possible. For example, a transducer capable of producing a vibrating alarm could be provided. As another example, if the cap of the container is a rotating cap or a snap-cap, a push-rod mechanism could engage and disengage electrical contact switches in the cap. For example, in a container having a snap-cap, a push-rod could extend in a lateral direction to engage the neck or the side of the receptacle and, subsequently, be forced against an electrical contact switch. A resilient prong of the electrical contact switch could force the push-rod outward when the container is in an opened-position.

Similarly, other mechanisms are possible to select the desired timing schedule. Among other examples, the cap could include an electrical connection that allows a pharmacist to input a signal to the cap that selects the desired timing schedule. The cap could include a switching mechanism accessible by a specially adapted tool to prevent altering the position of the switch by a patient. The medication container could include one type of cap in conjunction with a plurality of rings that a pharmacist would select and attach to provide the appropriate timing schedule. The cap could contain depressible/locking buttons that would select a particular timing schedule when certain combinations of buttons are depressed into a locked position. The appropriate timing schedule could be selected by cutting one or a combination of wires, or the appropriate timing schedule could be selected by inserting a pin through one or more holes in the cap.

In addition, numerous other algorithms could implement the described functions, subfunctions, and automatic modes, or algorithms could incorporate different functions and modes and different combinations of functions and modes. For example, additional timing schedules can be provided. Also, additional selectable modes could be provided, such as an option to select a 30 day or 60 day duration of operation of the container. For mass production, a customized IC, which incorporates algorithms and additional electrical components such as capacitors 168, 170, may be preferable to IC 164.

The embodiments of medication containers 10, 300 disclosed herein, including all dimensions, materials, structures, arrangements, combinations of parts, algorithms, functions, subfunctions, and modes, are provided as examples. It is evident that those skilled in the art may now make numerous modifications to and uses of and departures from the specific apparatus and techniques disclosed herein without departing from the inventive concepts. Consequently, the invention is to be construed as embracing each and every novel feature and novel combination of features present in or possessed by the apparatus and techniques disclosed herein and limited only by the spirit and scope of the appended claims.

What is claimed is:

1. A device including a can attachable to a receptacle for coacting therewith in enclosing medication and timing a predetermined interval for taking the medication defined by one timing schedule of a set of selectable timing schedules, the device comprising:

an electronic timing circuit constructed and arranged to provide an alarm signal designating a time for taking the medication at the expiration of a predetermined time interval defined by the timing schedule;

said electronic timing circuit being housed in said cap and including schedule processing circuitry that defines the set of selectable timing schedules, and a set of outputs for issuing electrical signals at the expiration of the predetermined time interval;

a sensing mechanism housed in said cap for selectively engaging an input corresponding to a selected one of the timing schedules of the set; and the sensing mechanism electrically engaging the input when in a first position and electrically disengaged from the input when in a second position.

2. The device of claim 1 wherein the sensing mechanism is in mechanical communication with the selectively engaged input.

3. The device of claim 2 wherein the sensing mechanism is constructed and arranged to move between the first and second positions in response to a nonfrictional normal force.

4. The device of claim 1 wherein the engaged input causes an electrical current to pass through the engaged input to the timing circuit to establish the selected one of the timing schedules.

5. The device of claim 1 further comprising at least one alarm transducer housed in said cap coupled to the timing circuit responsive to the alarm signal for providing a sensible alarm.

6. The device of claim 5 further comprising first and second alarm transducers for providing first and second sensible alarms respectively.

7. The device of claim 6 wherein the first and second sensible alarms are visual and audible respectively.

8. The device of claim 1 further comprising a power source housed in said cap and an activation mechanism housed in said cap having an activated position and a deactivated position, wherein the activation mechanism engages the electronic timing circuit to electrically connect the power source to the timing circuit when in the activated position, and wherein the power source is disengaged from the timing circuit when the activation mechanism is in the deactivated position.

9. The device of claim 1 wherein the electronic timing circuit includes a reset input and further comprises a reset mechanism in communication with the electronic timing circuit such that the reset mechanism is capable of engaging the reset input to activate a set of functions defined by the processing circuitry.

10. The device of claim 1 wherein the electronic timing circuit includes synchronization circuitry for synchronizing the predetermined timing interval schedule relative to an event external to the device.

11. The device of claim 1 wherein the electronic timing circuit includes muting circuitry for suppressing the alarm signal when the device is not in use.

12. The device of claim 1 wherein the electronic timing circuit includes alarm preempt circuitry for suppressing the alarm signal when the sensing mechanism moves between the first and second positions within a predetermined subinterval.

13. The device of claim 12 wherein the predetermined subinterval is an interval extending prior to and until the expiration of a time interval of the predetermined timing interval schedule.

14. The device of claim 1 wherein the electronic timing circuit includes shut down circuitry for suppressing the alarm signal after a predetermined duration.

15. The device of claim 1 wherein the electronic timing circuit includes start delay circuitry for beginning an operational duration of the device upon an initiating event.

16. A method of timing a predetermined interval schedule defined by one schedule of a set of different timing schedules stored in the cap attachable to a receptacle, said cap housing an electronic circuit constructed and arranged to provide an alarm signal designating a time for taking medication in the receptacle at the expiration of a predetermined time interval defined by the predetermined interval schedule and housing a sensing mechanism for selectively engaging an input corresponding to the predetermined interval schedule comprising:

electromechanically selecting the predetermined interval schedule through the cap establishing a predetermined time interval as defined by the predetermined interval schedule; and issuing said alarm signal upon expiration of the predetermined time interval.

17. The method of claim 16 further comprising:

relatively displacing the cap and receptacle to open the receptacle; and discontinuing the alarm signal in response to opening of the receptacle.

18. The method of claim 16 wherein the set of timing schedules includes timing schedules corresponding to different patient types.

19. The method of claim 16 wherein the can has a power source that is initially dormant and further comprising activating the power source of the cap.

20. The method of claim 16 further comprising:

sensing when the receptacle is not in use, and suppressing the alarm signal when the receptacle is not in use.

21. The method of claim 16 further comprising synchronizing the selected timing schedule to an external event.

22. The method of claim 16 further comprising suppressing the alarm signal after a predetermined duration.

23. A cap of a container for attachment to a receptacle of the container, the cap comprising:

an electronic timing circuit constructed and arranged to provide an alarm signal at the expiration of a predetermined time interval defined by a timing schedule of a set of selectable timing schedules;

said electronic timing circuit being housed in the cap and including schedule processing circuitry that defines the set of selectable timing schedules, and an output for issuing electrical signals at the expiration of the predetermined time interval;

a sensing mechanism for selectively engaging an input corresponding to a selected one of the timing schedules of the set;

the sensing mechanism electrically engaging the input when in a first position and electrically disengaged from the input when in a second position;

wherein the sensing mechanism is constructed and arranged to move between the first and second positions in response to a nonfrictional normal force;

the sensing mechanism capable of being engaged by an adjacent surface of the receptacle; and the adjacent surface constructed and arranged to provide the nonfrictional normal force.

24. The cap of claim 23 wherein the nonfrictional normal force is a force in a rotational direction.

25. The cap of claim 23 wherein the nonfrictional normal force is a force in a longitudinal direction.

26. The cap of claim 23 further comprising:

a control mechanism directly adjacent to an outer surface of the cap; and wherein the control mechanism is recessed from the outer surface to provide protection for the control mechanism from external forces.

27. The cap of claim 23 further comprising:

a signal mechanism directly adjacent to an outer surface of the cap; and wherein the signal mechanism is recessed from the outer surface to provide protection for the signal mechanism from external forces.

28. The cap of claim 23 further comprising a switch mechanism having a resilient member, the switch mechanism responsive to a force capable of causing the switch to engage an electrical contact point, a resilient force causing the switch to disengage the electrical contact point.

29. The cap of claim 28 wherein the switch mechanism further comprises a plurality of electrical contacts capable of simultaneously engaging a plurality of electrical contact points.

* * * * *

UNITED STATES PATENT AND TRADEMARK OFFICE

CERTIFICATE OF CORRECTION

PATENT NO. : 6,084,504
APPLICATION NO. : 09/223128
DATED : July 4, 2000
INVENTOR(S) : Roger M. Rosche and Han Kort It is certified that error appears in the above-identified patent and that said Letters Patent is hereby corrected as shown below:

Col. 17, in claim 1, first line, “can” should read --cap--.

Signed and Sealed this

Twenty-third Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 6,084,504
APPLICATION NO. : 09/223128
DATED : July 4, 2000
INVENTOR(S) : Roger M. Rosche and Han Kort It is certified that error appears in the above-identified patent and that said Letters Patent is hereby corrected as shown below:

Col. 17, in claim 1, line 17, “can” should read --cap--.

This certificate supersedes the Certificate of Correction issued December 23, 2008.

Signed and Sealed this

Twentieth Day of January, 2009

JON W. DUDAS
*Director of the United States Patent and Trademark Office*